US011851150B2

(12) United States Patent
Perdomo Tornbaum et al.

(10) Patent No.: US 11,851,150 B2
(45) Date of Patent: Dec. 26, 2023

(54) PROPULSION DEVICES WITH LOCK DEVICES AND METHODS OF MAKING PROPULSION DEVICES WITH LOCK DEVICES FOR MARINE VESSELS

(71) Applicant: Brunswick Corporation, Mettawa, IL (US)

(72) Inventors: Andres Perdomo Tornbaum, Neenah, WI (US); Wayne M. Jaszewski, Jackson, WI (US); Robert A. Podell, Slinger, WI (US); Jeremy J. Kraus, Mt.Calvary, WI (US); James E. Erickson, Fond du Lac, WI (US); Randall J. Poirier, Fond du Lac, WI (US); Derek J. Fletcher, Oshkosh, WI (US); Matthew Z. Seta, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 17/379,435

(22) Filed: Jul. 19, 2021

(65) Prior Publication Data

US 2022/0266970 A1 Aug. 25, 2022

Related U.S. Application Data

(63) Continuation-in-part of application No. 17/185,289, filed on Feb. 25, 2021, now Pat. No. 11,572,146.

(51) Int. Cl.

| | |
|---|---|
| ***B63H 20/10*** | (2006.01) |
| ***B63H 25/42*** | (2006.01) |
| ***B63H 20/06*** | (2006.01) |

(52) U.S. Cl.
CPC ..... *B63H 20/10* (2013.01); *B63H 20/06* (2013.01); *B63H 25/42* (2013.01); *B63H 2025/425* (2013.01)

(58) Field of Classification Search
CPC ..... B63H 21/21; B63H 1/14; B63H 21/12; B63H 23/04; B63H 2005/1258;
(Continued)

(56) References Cited

U.S. PATENT DOCUMENTS

| | | |
|---|---|---|
| 2,213,520 A | 9/1940 | Gentry |
| 3,462,102 A | 8/1969 | Rivers |

(Continued)

FOREIGN PATENT DOCUMENTS

| | | |
|---|---|---|
| EP | 1611007 | 8/2007 |
| EP | 1914161 | 4/2008 |

(Continued)

OTHER PUBLICATIONS

International Search Report and Written Opinion for International Application No. PCT/CA/2016/050308 dated Jun. 9, 2016.

*Primary Examiner* — Andrew Polay
(74) *Attorney, Agent, or Firm* — Andrus Intellectual Property Law, LLP

(57) ABSTRACT

A propulsion device for a marine vessel. The propulsion device includes a base configured to be coupled to the marine vessel. A propulsor is pivotally coupled to the base and pivotable into and between a deployed position and a stowed position. The propulsor is configured to propel the marine vessel in water when in the deployed position. A lock device has a rigid member and is selectively engageable such that the rigid member prevents the propulsor from pivoting away from the stowed position.

20 Claims, 23 Drawing Sheets

(58) Field of Classification Search
CPC B63H 2025/425; B63H 20/007; B63H 20/10; B63H 20/106; B63H 20/08; B63H 20/06; B63H 25/42; B63B 1/125; B63B 35/38; B63B 79/10; B63B 35/613
See application file for complete search history.

(56) References Cited

U.S. PATENT DOCUMENTS

| | | | | |
|---|---|---|---|---|
| 3,809,343 | A | 5/1974 | Adams et al. | |
| 3,865,335 | A | 2/1975 | Roller et al. | |
| 3,874,318 | A | 4/1975 | Langley | |
| 3,995,579 | A | 12/1976 | Childre | |
| 3,999,500 | A | 12/1976 | Friedel et al. | |
| 4,008,680 | A | 2/1977 | Alexander, Jr. | |
| 4,294,186 | A | 10/1981 | Wardell | |
| 4,410,161 | A | 10/1983 | Booty | |
| 4,548,586 | A | 10/1985 | Philips | |
| 4,734,068 | A | 3/1988 | Edwards | |
| 4,875,656 | A | 10/1989 | Boede | |
| 4,911,398 | A | 3/1990 | Diiulio et al. | |
| 4,966,566 | A | 10/1990 | Baird | |
| 5,005,798 | A | 4/1991 | McCoy | |
| 5,022,609 | A | 6/1991 | Cranston | |
| 5,131,875 | A | 7/1992 | Lee | |
| 5,152,240 | A | 10/1992 | Fontanille | |
| 5,195,914 | A | 3/1993 | Binversie et al. | |
| 5,277,630 | A | 1/1994 | Clark | |
| 5,499,792 | A | 3/1996 | Tamiso | |
| 5,639,272 | A | 6/1997 | Henderson et al. | |
| 5,669,794 | A | 9/1997 | Knight et al. | |
| 5,941,742 | A | 8/1999 | Whitaker | |
| 6,142,841 | A | 11/2000 | Alexander, Jr. et al. | |
| 6,280,267 | B1 | 8/2001 | Griffith, Sr. et al. | |
| 6,325,685 | B1 | 12/2001 | Knight et al. | |
| 6,431,923 | B1 | 8/2002 | Knight et al. | |
| 6,592,412 | B1 | 7/2003 | Geil et al. | |
| 6,789,648 | B2 | 9/2004 | Cook | |
| 7,004,803 | B2 | 2/2006 | Ruffe | |
| 7,004,804 | B2 | 2/2006 | Bernloehr et al. | |
| RE39,032 | E | 3/2006 | Gonring et al. | |
| 7,150,662 | B1 | 12/2006 | Janitz | |
| 7,285,029 | B1 | 10/2007 | Janitz | |
| 7,294,029 | B1 * | 11/2007 | Spaulding | B63H 20/36 440/6 |
| 7,305,928 | B2 | 12/2007 | Bradley et al. | |
| 7,399,211 | B1 | 7/2008 | Spaulding | |
| 7,510,450 | B1 | 3/2009 | Dresher | |
| 7,520,239 | B2 | 4/2009 | Bryham | |
| 7,753,745 | B2 | 7/2010 | Schey et al. | |
| 7,887,381 | B2 | 2/2011 | Brass et al. | |
| 7,946,243 | B1 | 5/2011 | Ulrich | |
| 8,011,982 | B1 | 9/2011 | Baier et al. | |
| 8,051,793 | B2 | 11/2011 | Ulgen | |
| 8,479,677 | B2 | 7/2013 | Bolline et al. | |
| 9,296,455 | B2 | 3/2016 | Bernloehr et al. | |
| 9,586,655 | B1 | 3/2017 | Butler | |
| 9,738,364 | B2 | 8/2017 | Abney | |
| 9,889,914 | B1 | 2/2018 | Ostrowsky | |
| 9,896,162 | B2 | 2/2018 | McClure | |
| 9,969,474 | B1 * | 5/2018 | Truax | B63H 20/007 |
| 10,167,069 | B2 | 1/2019 | Houle et al. | |
| 10,220,926 | B1 | 3/2019 | Pelini | |
| 10,850,820 | B1 | 12/2020 | Minogue | |
| 11,591,057 | B2 | 2/2023 | Tornbaum et al. | |
| 11,603,179 | B2 | 3/2023 | Poirier et al. | |
| 2002/0142680 | A1 | 10/2002 | Anderson | |
| 2005/0159053 | A1 | 7/2005 | Ruffe | |
| 2007/0232159 | A1 | 10/2007 | Lee | |
| 2009/0227158 | A1 * | 9/2009 | Bernloehr | B63H 20/08 440/63 |
| 2010/0032545 | A1 * | 2/2010 | Bernloehr | B63H 20/08 248/640 |
| 2010/0116967 | A1 | 5/2010 | Todd et al. | |
| 2010/0136857 | A1 | 6/2010 | Goudsmit | |
| 2016/0001865 | A1 | 1/2016 | Bernloehr et al. | |
| 2017/0203823 | A1 | 8/2017 | Abney | |
| 2017/0341718 | A1 | 11/2017 | Zimmerman | |
| 2018/0057130 | A1 * | 3/2018 | Houle | B63H 20/06 |
| 2018/0334233 | A1 | 11/2018 | Vance, Jr. | |

FOREIGN PATENT DOCUMENTS

| | | |
|---|---|---|
| EP | 2757037 | 7/2014 |
| EP | 2242678 | 11/2015 |
| EP | 2246252 | 5/2019 |
| JP | 2013100013 | 5/2013 |

* cited by examiner

PROPULSION DEVICES WITH LOCK DEVICES AND METHODS OF MAKING PROPULSION DEVICES WITH LOCK DEVICES FOR MARINE VESSELS

CROSS REFERENCE TO RELATED APPLICATION

This application is a continuation-in-part of U.S. patent application Ser. No. 17/185,289, filed Feb. 25, 2021, which is incorporated herein by reference in its entirety.

FIELD

The present disclosure generally relates to stowable propulsors for marine vessels.

BACKGROUND

The following U.S. Patents provide background information and are incorporated by reference in entirety.

U.S. Pat. No. 6,142,841 discloses a maneuvering control system which utilizes pressurized liquid at three or more positions of a marine vessel to selectively create thrust that moves the marine vessel into desired locations and according to chosen movements. A source of pressurized liquid, such as a pump or a jet pump propulsion system, is connected to a plurality of distribution conduits which, in turn, are connected to a plurality of outlet conduits. The outlet conduits are mounted to the hull of the vessel and direct streams of liquid away from the vessel for purposes of creating thrusts which move the vessel as desired. A liquid distribution controller is provided which enables a vessel operator to use a joystick to selectively compress and dilate the distribution conduits to orchestrate the streams of water in a manner which will maneuver the marine vessel as desired.

U.S. Pat. No. 7,150,662 discloses a docking system for a watercraft and a propulsion assembly therefor wherein the docking system comprises a plurality of the propulsion assemblies and wherein each propulsion assembly includes a motor and propeller assembly provided on the distal end of a steering column and each of the propulsion assemblies is attachable in an operating position such that the motor and propeller assembly thereof will extend into the water and can be turned for steering the watercraft.

U.S. Pat. No. 7,305,928 discloses a vessel positioning system which maneuvers a marine vessel in such a way that the vessel maintains its global position and heading in accordance with a desired position and heading selected by the operator of the marine vessel. When used in conjunction with a joystick, the operator of the marine vessel can place the system in a station keeping enabled mode and the system then maintains the desired position obtained upon the initial change in the joystick from an active mode to an inactive mode. In this way, the operator can selectively maneuver the marine vessel manually and, when the joystick is released, the vessel will maintain the position in which it was at the instant the operator stopped maneuvering it with the joystick.

U.S. Pat. No. 7,753,745 discloses status indicators for use with a watercraft propulsion system. An example indicator includes a light operatively coupled to a propulsion system of a watercraft, wherein an operation of the light indicates a status of a thruster system of the propulsion system.

U.S. Pat. No. RE39032 discloses a multipurpose control mechanism which allows the operator of a marine vessel to use the mechanism as both a standard throttle and gear selection device and, alternatively, as a multi-axes joystick command device. The control mechanism comprises a base portion and a lever that is movable relative to the base portion along with a distal member that is attached to the lever for rotation about a central axis of the lever. A primary control signal is provided by the multipurpose control mechanism when the marine vessel is operated in a first mode in which the control signal provides information relating to engine speed and gear selection. The mechanism can also operate in a second or docking mode and provide first, second, and third secondary control signals relating to desired maneuvers of the marine vessel.

European Patent Application No. EP 1,914,161, European Patent Application No. EP2,757,037, and Japanese Patent Application No. JP2013100013A also provide background information and are incorporated by reference in entirety.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

The present disclosure generally relates to a propulsion device for a marine vessel. The propulsion device includes a base configured to be coupled to the marine vessel. A propulsor is pivotally coupled to the base and pivotable into and between a deployed position and a stowed position. The propulsor is configured to propel the marine vessel in water when in the deployed position. A lock device has a rigid member and is selectively engageable such that the rigid member prevents the propulsor from pivoting away from the stowed position.

The present disclosure further relates to methods for making a propulsion device for a marine vessel. One method includes configuring a base to be coupleable to the marine vessel and pivotably coupling a propulsion to the base, where the propulsor is pivotable into and between a deployed position and a stowed position, and where the propulsor is configured to propel the marine vessel in water when in the deployed position. The method further comprises coupling a lock device to the base, the lock device having a rigid member and being selectively engageable to prevent the propulsor from pivoting away from the stowed position.

Various other features, objects and advantages of the disclosure will be made apparent from the following description taken together with the drawings.

BRIEF DESCRIPTION OF THE DRAWINGS

The present disclosure is described with reference to the following Figures.

DETAILED DISCLOSURE

The present inventors have recognized a problem with bow thrusters presently known in the art, and particularly those that are retractable for storage. Specifically, within the context of a marine vessel having pontoons, there is insufficient clearance between the pontoons to accommodate a propulsive device, and particularly a propulsive device oriented to create propulsion in the port-starboard direction. The problem is further exacerbated when considering how marine vessels are trailered for transportation over the road. One common type of trailer is a scissor type lift in which bunks are positioned between the pontoons to lift the vessel by the underside of the deck. An exemplary lift of this type is the "Scissor Lift Pontoon Trailer" manufactured by Karavan in Fox Lake, WI In this manner, positioning a bow thruster between a marine vessel's pontoons either precludes the use of a scissor lift trailer, or leaves so little clearance that damage to the bow thruster and/or trailer is likely to occur during insertion, lifting, and/or transportation of the vessel on the trailer. As such, the present inventors have realized it would be advantageous to rotate the propulsor in a fore-aft orientation when stowed to minimize the width of the bow thruster. Additionally, the present inventors have recognized the desirability of developing such a rotatable propulsor that does not require additional actuators for this rotation, adding cost and complexity to the overall system.

Figure 1:
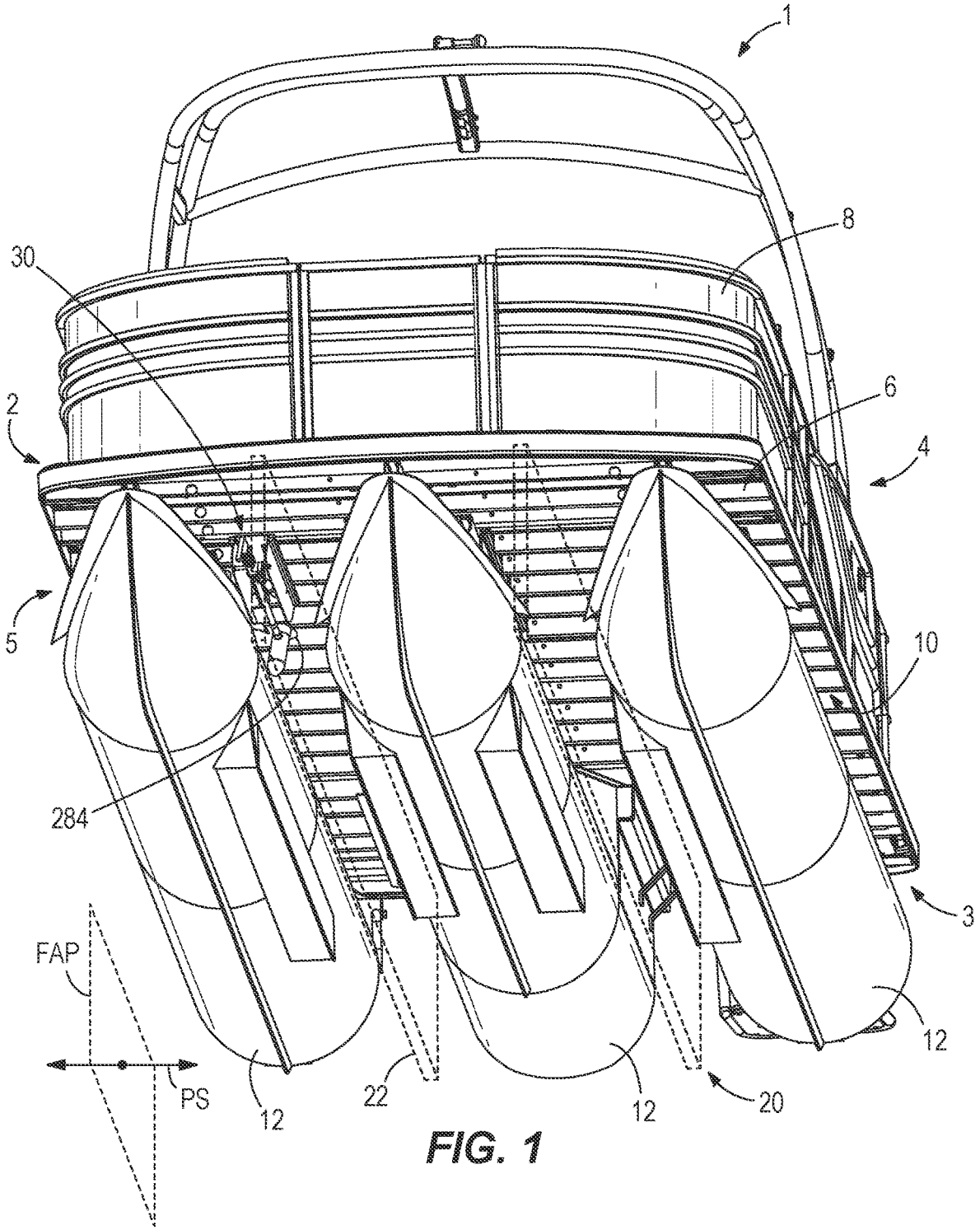
FIG. 1 is an isometric bottom view of a propulsion device coupled to a marine vessel and having a propulsor.

FIG. 1 depicts the underside of a marine vessel 1 as generally known in the art, but outfitted with an embodiment of a stowable propulsion device 30 according to the present disclosure. The marine vessel 1 extends between a bow 2 and a stern 3, as well as between port 4 and starboard 5 sides, thereby defining a fore-aft plane FAP, and port-starboard direction PS. The marine vessel 1 further includes a deck 6 with a rail system 8 on top and pontoons 12 mounted to the underside 10 of the deck 6. The marine vessel 1 is shown with a portion of a scissor type lift 20, specifically the bunks 22, positioned between pontoons 12 to lift and support the marine vessel 1 for transportation over land in a manner known in the art. As is discussed further below, embodiments of a novel stowable propulsion device 30 have a propeller 284 that faces the underside 10 of the deck 6 when stowed, in contrast to during use to propel the marine vessel 1 in the water as a bow thruster. This is distinguishable from propulsion devices known in the art, in which the propeller faces the pontoons. In prior art configurations, there typically is insufficient room between the propulsion device and the pontoons to fit the bunks of the scissor type lift without risking damage to the propulsion device while inserting the bunks, lifting the marine vessel, and/or traveling on the road.

Figure 2:
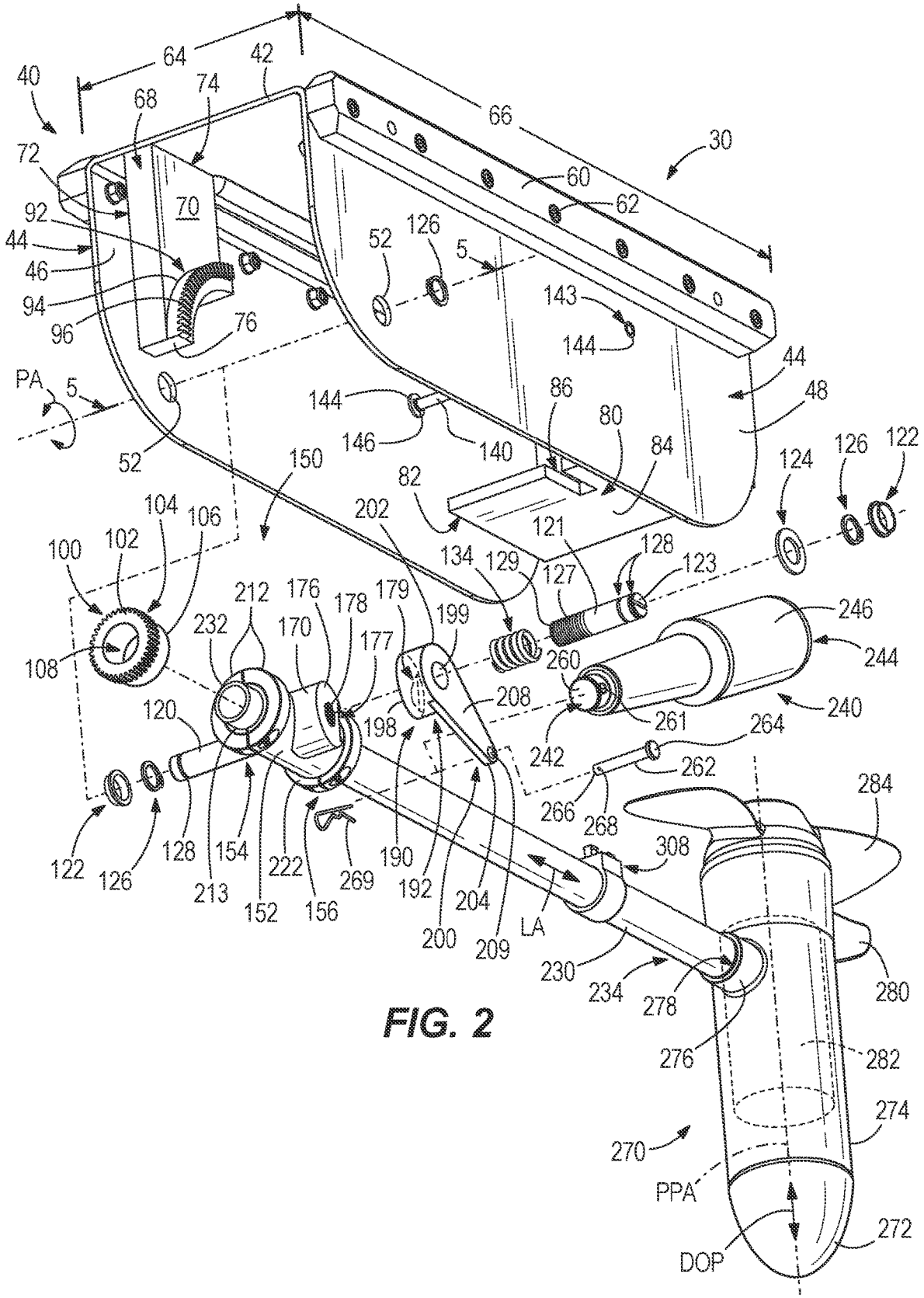
FIG. 2 is an exploded isometric view showing the propulsor from FIG. 1 in a stowed position.
Figure 3:
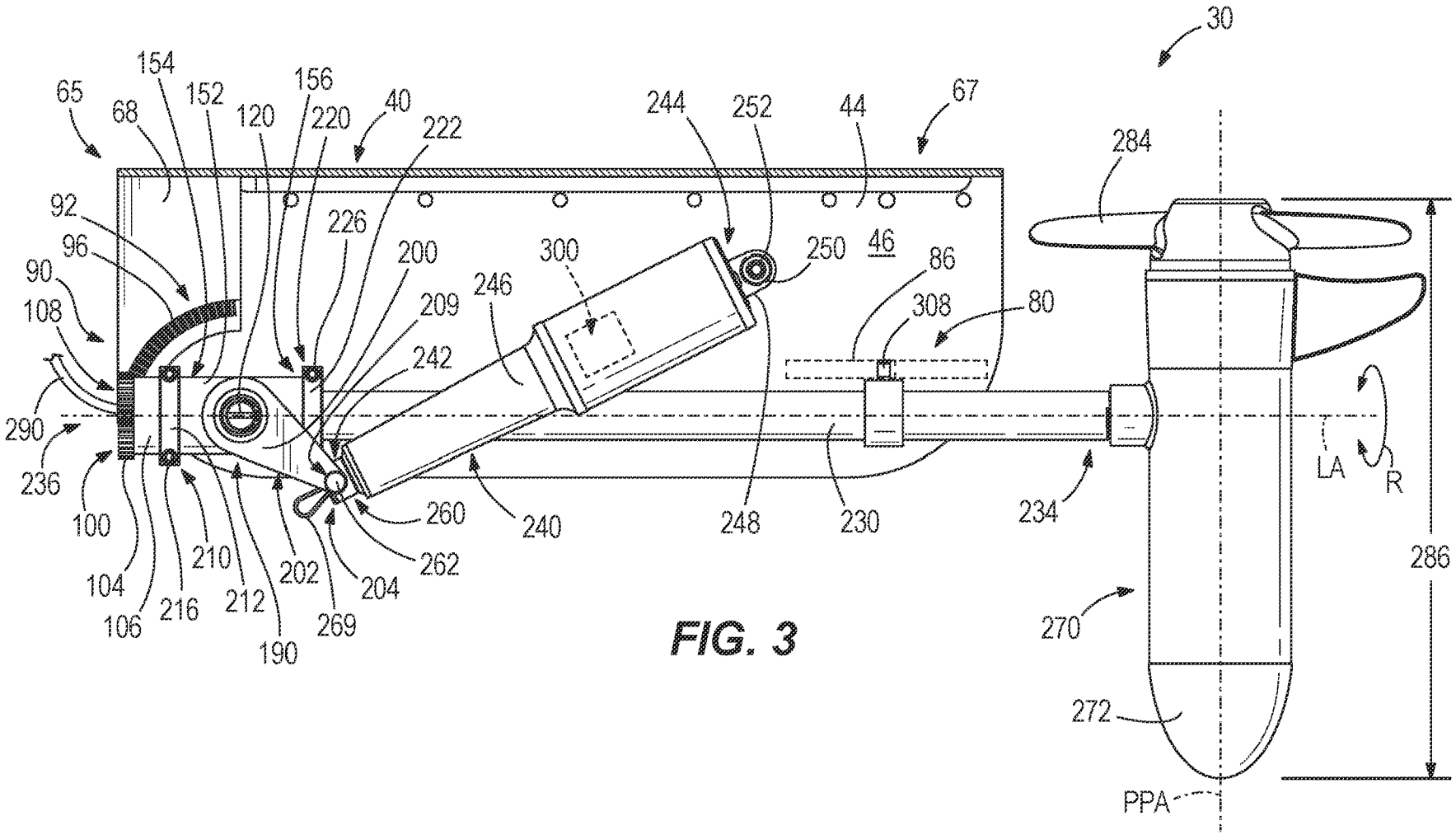
FIG. 3 is a sectional side view of the propulsion device shown in FIG. 2.
Figure 4:
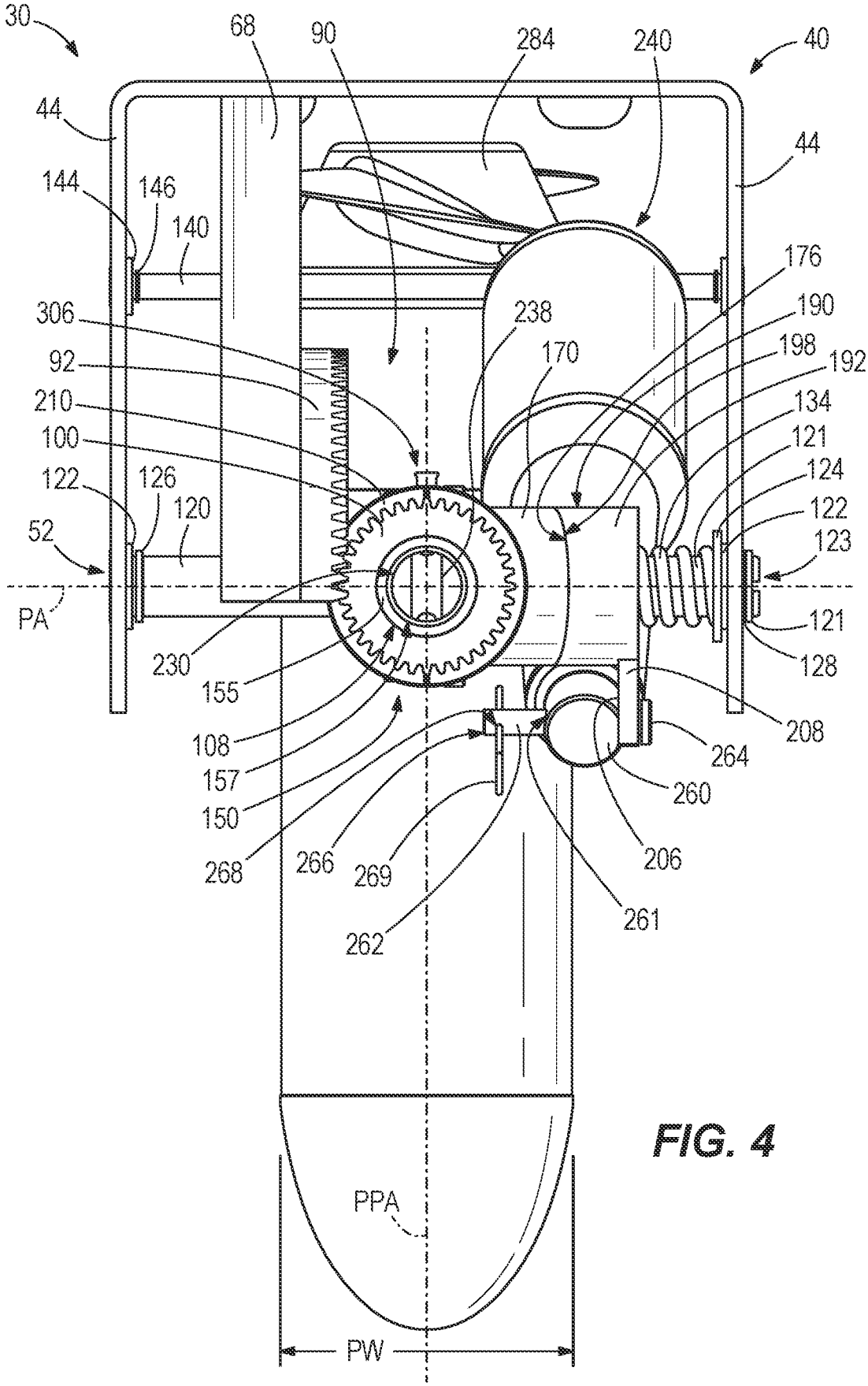
FIG. 4 is a rear view of the propulsion device shown in FIG. 2.

FIGS. 2-3 depict an exemplary stowable propulsion device 30 according to the present disclosure, here oriented in a stowed position. The stowable propulsion device 30 includes a base 40 having a top 42 with sides 44 extending perpendicularly downwardly away from the top 42. The sides 44 include an inward side 46 and outward side 48 and extend between a first end 65 and second end 67 defining a length 66 therebetween. A width 64 is defined between the sides 44. A stop 80 having sides 82 and a bottom 84 is coupled between the sides 44 of the base 40. A leg 68 having an inward side 70 and outward side 72 extends between a top end 74 and a bottom end 76. The leg 68 is coupled at the top end 74 to the top 42 of the base 40 and extends perpendicularly downwardly therefrom. A stationary gear 92 having a mesh face 96 with gear teeth and an opposite mounting face 94 is coupled to the leg 68 with the mounting face 94 facing the inward side 70 of the leg 68. As shown in FIG. 4, one or more support rods 140 may also be provided between the sides 44 and received within support rod openings 143 defined therein to provide rigidity to the base 40. In the example shown, the support rod 140 is received within a bushing 144 and held in position by a snap ring 146 received within a groove defined within the support rod 140.

Returning to FIGS. 2-3, the base 40 is configured to be coupled to the marine vessel 1 with the top 42 facing the underside 10 of the deck 6. The base 40 may be coupled to the deck 6 using fasteners and brackets presently known in the art. A mounting bracket 60 is coupled via fasteners 62 (e.g., screws, nuts and bolts, or rivets) to the outward sides 48 of the sides 44 of the base 40, or in some cases formed as an extrusion. The mounting bracket 60 is receivable in a C-channel bracket or other hardware known in the art (not shown) that is coupled to the deck 6 and/or pontoons 12 to thereby couple the stowable propulsion device 30 thereto.

As shown in FIGS. 2-4, the stowable propulsion device 30 includes a shaft 230 that extends between a proximal end 232 and distal end 234 defining a length axis LA therebetween. The proximal end 232 of the shaft 230 is non-rotatably coupled to a moving gear 100. The moving gear 100 has a proximal face 102 and mesh face 104 having gear teeth, where the mesh face 104 engages with the mesh face 96 of the stationary gear 92 to together form a gearset 90 as discussed further below. The moving gear 100 further includes a barrel 106 that extends perpendicularly relative to the proximal face 102 and is coupled to the shaft 230 in a manner known in the art (e.g., via a set screw or welding). In this manner, the moving gear 100 is fixed to the shaft 230 such that rotation of the moving gear 100 causes rotation of the shaft 230 about the length axis LA.

Figure 5:
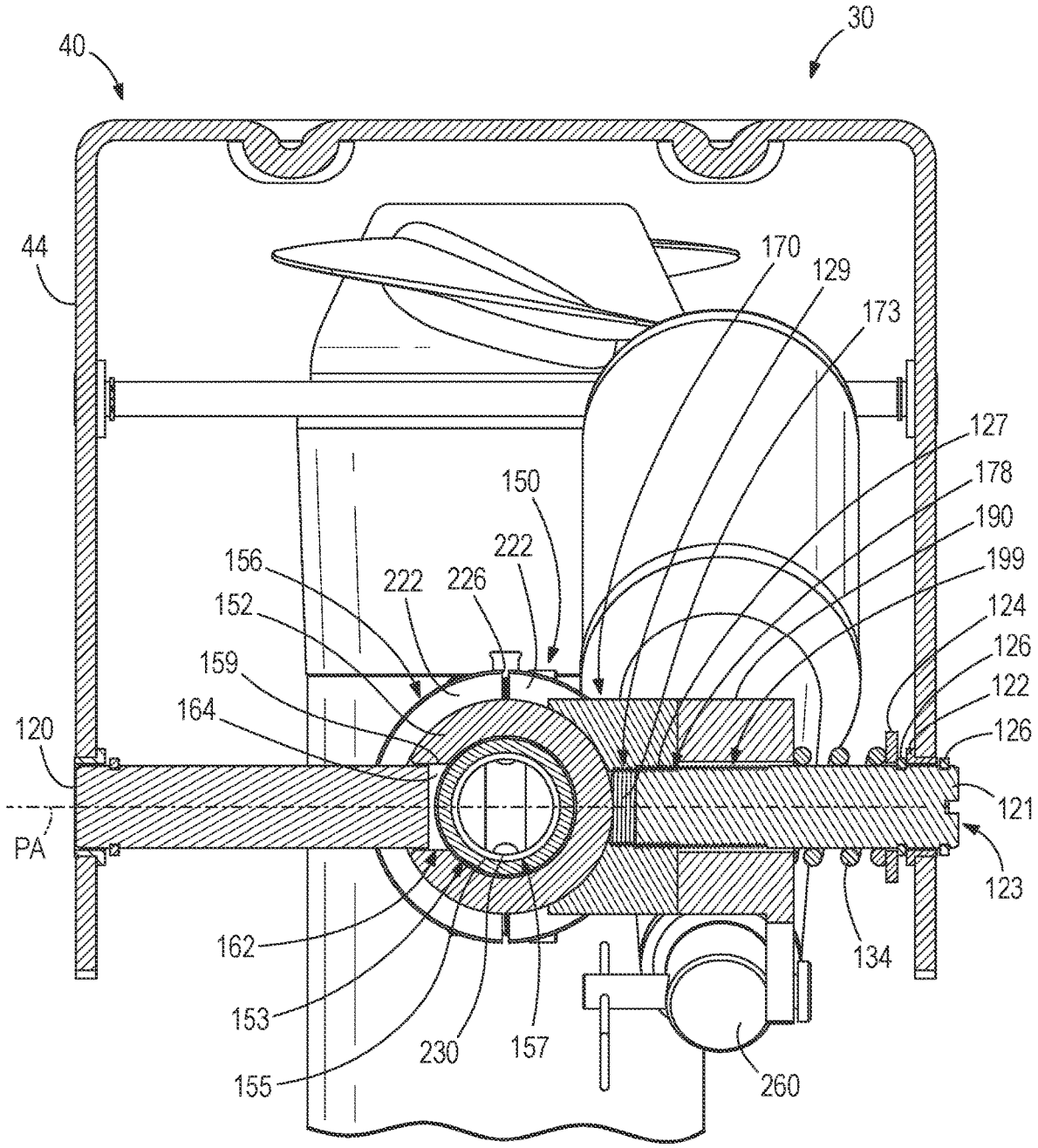
FIG. 5 is a sectional view taken along the line 5-5 of FIG. 2.
Figure 6:
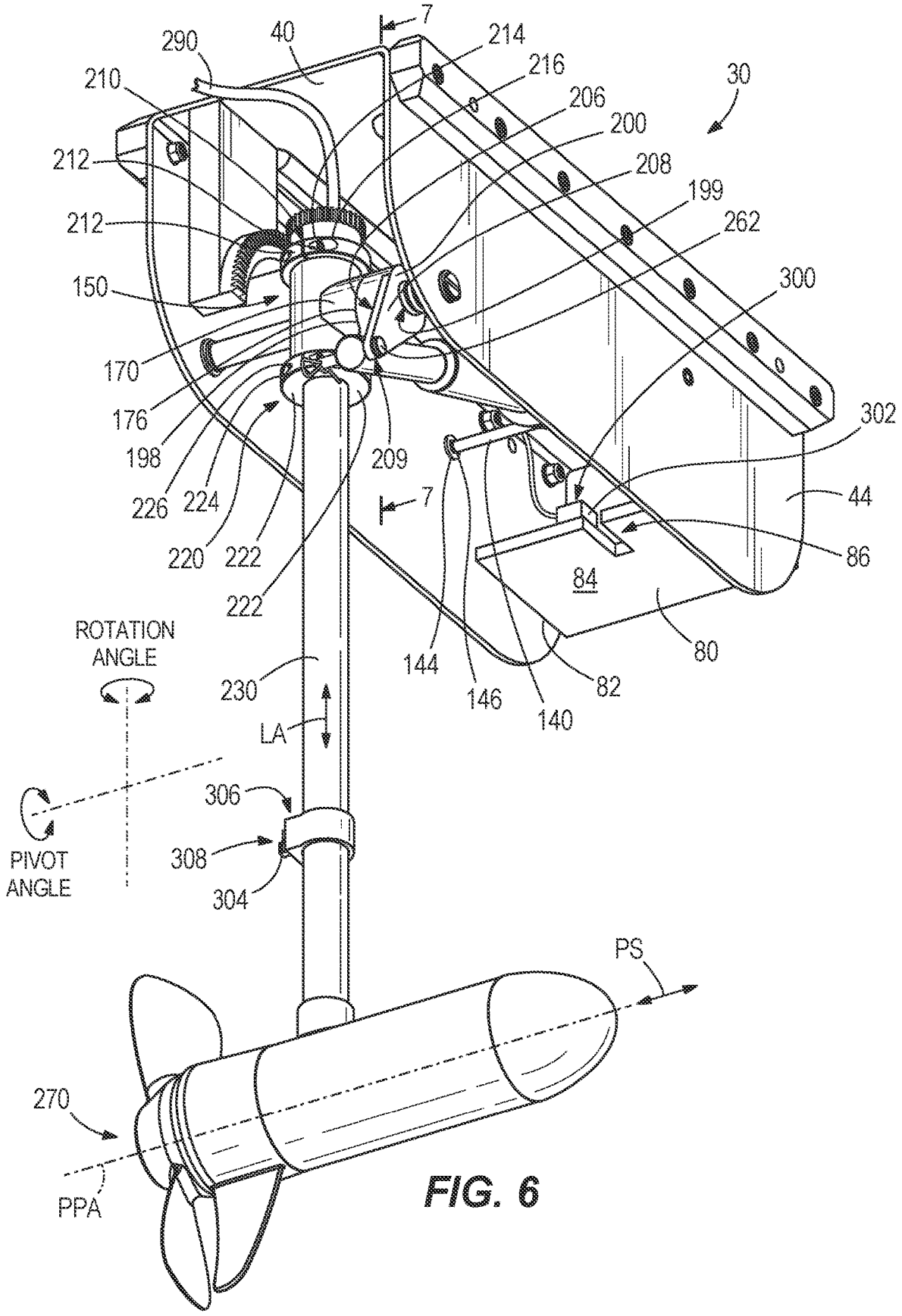
FIG. 6 is an isometric bottom view showing the propulsor from FIG. 2 in a deployed position.
Figure 7:
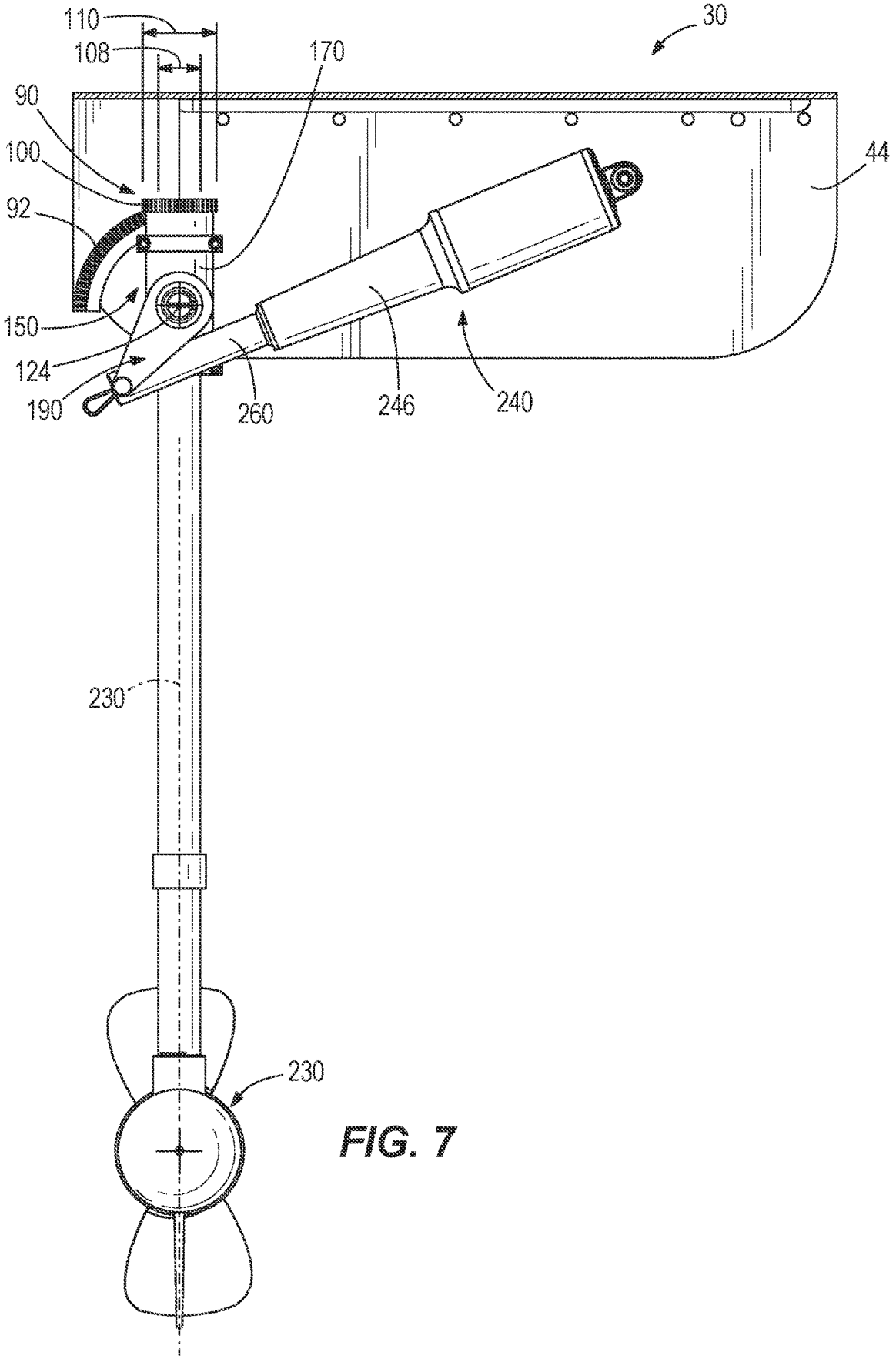
FIG. 7 is a sectional side view taken along the line 7-7 in FIG. 6.
Figure 8:
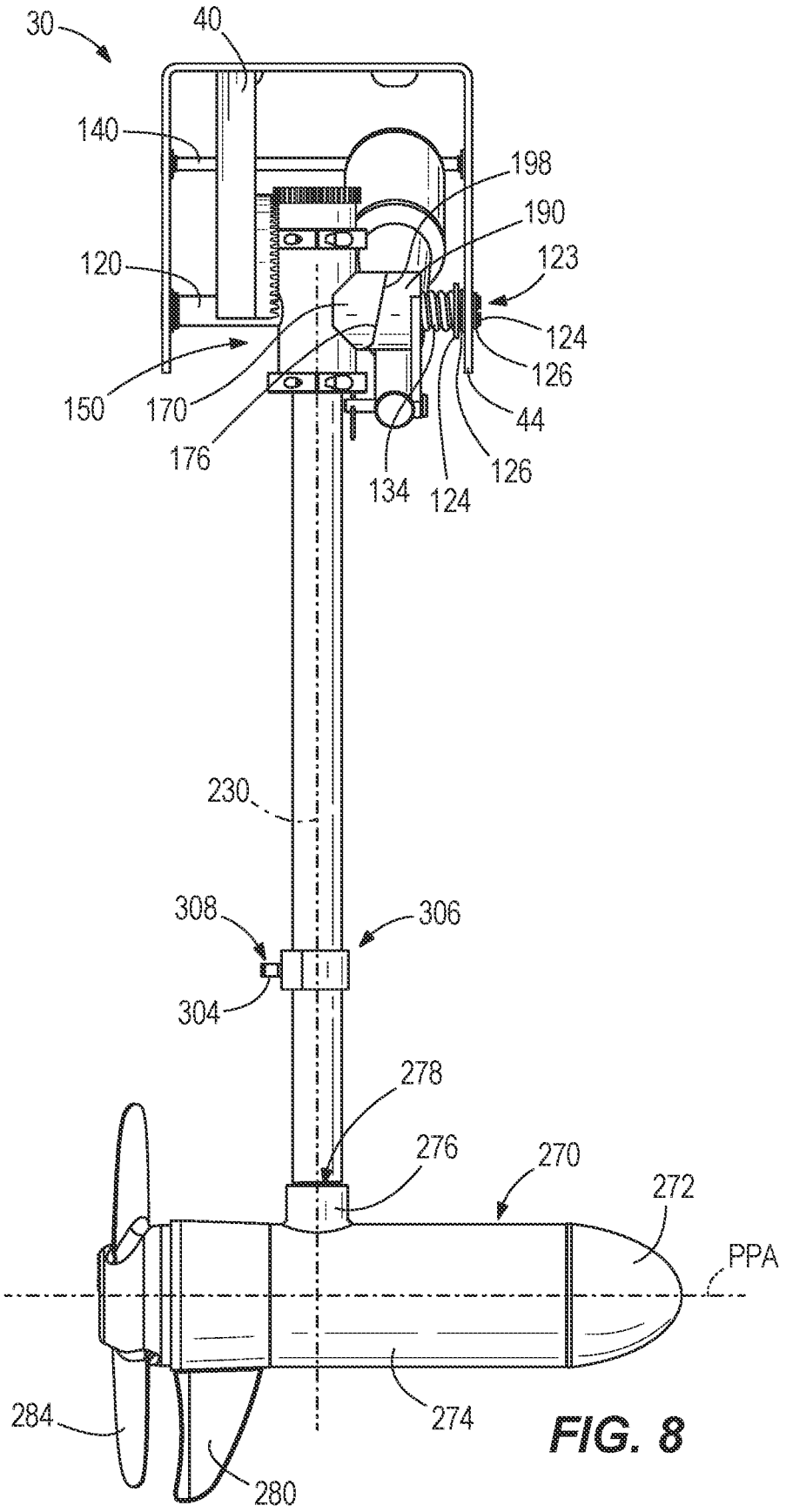
FIG. 8 is a rear view of the propulsion device as shown in FIG. 6.

With reference to FIGS. 2 and 5-6, a pivot rotation device 150 is coupled to the shaft 230 near its proximal end 232, below the moving gear 100. The pivot rotation device 150 includes a main body 152 extending between a first end 154 and a second end 156 with an opening 153 defined therebetween. The shaft 230 is received through the opening 153 between the first end 154 and second end 156 of the main body 152 and rotatable therein. In the embodiment shown, a bushing 155 is received within the opening 153 of the main body 152 and the shaft 230 extends through an opening 157 within the bushing 155. The bushing 155 provides for smooth rotation between the shaft 230 and the main body 152. The shaft 230 is retained within the main body 152 via first and second clamp systems 210, 220. The first clamp system 210 includes two clamp segments 212 coupled together by fasteners 216 received within openings and receivers therein, for example threaded openings for receiving the fasteners 216. The clamp segments 212 are configured to clamp around the shaft 230 just above the main body 152, in the present example with a gasket 213 sandwiched therebetween to provide friction. Likewise, clamp segments 222 of the second clamp system 220 are coupled to each other via fasteners 226 to clamp onto the shaft just below the main body 152, which may also include a gasket sandwiched therebetween. In this manner, the shaft 230 is permitted to rotate within the main body 152, but the first and second clamp systems 210, 220 on opposing ends of the main body 152 prevent the shaft 230 from moving axially through the main body 152.

As shown in FIGS. 2-3 and 5, the shaft 230 is pivotable about a transverse axis (shown as pivot axis PA) formed by coaxially-aligned pivot axles 120, 121. The pivot axles 120, 121 are received within pivot axle openings 52 defined within the sides 44 of the base 40, with bushings 122 therebetween to prevent wear. Snap rings 126 are receivable within grooves 128 defined within the pivot axles 120, 121 to retain the axial position of the pivot axles 120, 121 within the base 40. The interior ends of the pivot axles 120, 121 are received within the main body 152 of the pivot rotation device 150 coupled to the shaft 230. The pivot axle 120 is received within a pivot axle opening 162 of the main body 152 such that the outer surface of the pivot axle 120 engages an interior wall 159 of the main body 152. In the embodiment of FIG. 5, a gap 164 remains at the end of the pivot axle 120 to allow for tolerancing and bending and/or movement of the sides 44 of the base 40.

With continued reference to FIG. 5, the pivot rotation device 150 further includes an extension body 170 that extends away from the main body 152. The extension body 170 defines a pivot axle opening 178 therein for receiving the pivot axle 121. The pivot axle 121 has an insertion end 129 with threads 127 defined thereon, which engage with threads 173 of the pivot axle opening 178 defined in the extension body 170. A slot 123 is defined in the end of the pivot axle 121 opposite the insertion end 129. The pivot axle 121 is therefore threadably received within the extension body 170 by rotating a tool (e.g., a flathead screwdriver) engaged within the slot 123 defined in the end of the pivot axle 121. A snap ring 126 may also be incorporated and receivable within grooves 128 defined in the pivot axle 121 to prevent axial translation of the pivot axle 121 relative to the sides 44 of the base 40.

As shown in FIG. 2, a face 176 of the extension body 170 defines a notch 177 recessed therein, which as will become apparent provides for non-rotational engagement with a pivot arm 190. The pivot arm 190 includes a barrel portion 192 having a face 198 with a protrusion 179 extending perpendicularly away from the face 198. The protrusion 179 is received within the notch 177 when the faces 176, 198 about each other to rotationally fix the pivot arm 190 and the extension body 170. It should be recognized that other configurations for rotationally fixing the pivot arm 190 and extension body 170 are also contemplated by the present disclosure, for example other keyed arrangements or fasteners.

The barrel portion 192 of the pivot arm 190 further defines a pivot axle opening 199 therethrough, which enables the pivot axle 121 to extend therethrough. The pivot arm 190 further includes an extension 200 that extends away from the barrel portion 192. The extension 200 extends from a proximal end 202 coupled to the barrel portion 192 to distal end 204, having an inward face opposite an outward face 208. A mounting pin opening 209 is defined through the extension 200 near the distal end 204, which as discussed below is used for coupling the pivot arm 190 to an actuator 240.

As shown in FIGS. 2 and 4, the pivot arm 190 is biased into engagement with the main body 152 of the pivot rotation device 150 via a biasing device, such as a spring 134. In the example shown, the spring 134 is a coil or helical spring that engages the outward face 208 of the extension 200 of the pivot arm 190 at one end and engages a washer 124 abutting a snap ring 126 engaged within a groove of the pivot axle 121 at the opposite end. In this manner, the spring 134 provides for a biasing force engaging the pivot arm 190 and the main body 152 such that the faces 176, 198 thereof remain in contact during rotation of the pivot arm 190, but also provides a safeguard. For example, if the shaft 230 experiences an impact force (e.g., a log strike), the presently disclosed configuration allows the protrusion 179 (shown here to have a rounded shape) to exit the notch 177 against the biasing force of the spring 134 to prevent the force from damaging other components, such as the actuator 240 coupled to the pivot arm 190 (discussed further below).

Referring to FIGS. 2-4, the stowable propulsion device 30 further includes an actuator 240 (presently shown is a linear actuator), which for example may be an electric, pneumatic, and/or hydraulic actuator presently known in the art. The actuator 240 extends between a first end 242 and second end 244 and has a stationary portion 246 and an extending member 260 that extends from the stationary portion 246 in a manner known in the art. The stationary portion 246 includes a mounting bracket 248 (FIG. 3) that is coupled to the base 40 via fasteners 252, such as bolts, for example. At the opposite end of the actuator 240, a mounting pin opening 261 extends through the extending member 260, which is configured to receive a mounting pin 262 therethrough to couple the extending member 260 to the pivot arm 190 of the pivot rotation device 150. The mounting pin 262 shown extends between a head 264 and an insertion end 266, which in the present example has a locking pin opening 268 therein for receiving a locking pin 269. The locking pin 269, for example a cotter pin, is inserted or withdrawn to removably retain the mounting pin 262 in engagement between the actuator 240 and the pivot arm 190. In the embodiment of FIGS. 2-4, it should be recognized that actuation of the actuator 240 thus causes pivoting of the shaft 230 about the pivot axis PA.

Referring to FIG. 2, the stowable propulsion device 30 further includes a propulsor 270 coupled to the distal end 234 of the shaft 230. The propulsor 270 may be of a type known in the art, such as an electric device operable by battery. In the example shown, the propulsor 270 includes a nose cone 272 extending from a main body 274. The main body 274 includes an extension collar 276 that defines a shaft opening 278, whereby the shaft 230 is received within the shaft opening 278 for coupling the shaft 230 to the propulsor 270. The propulsor 270 includes a motor 282 therein, whereby control and electrical power may be provided to the motor 282 by virtue of a wire harness 290 (FIG. 9, also referred to as a wire) extending through the shaft 230, in the present example via the opening 108 defined through the moving gear 100; however, it should be recognized that the wire harness 290 may enter the shaft 230 or propulsor 270 in other locations. In some configurations, the wire harness 290 also extends through a gasket 291 (FIG. 9) that prevents ingress of water or other materials into the shaft 230, for example. The propulsor 270 further includes a fin 280 and is configured to rotate the propeller 284 about a propeller axis PPA. The propulsor 270 extends a length 286 (FIG. 3) and provides propulsive forces in a direction of propulsion DOP. With reference to FIG. 4, the propulsor 270 has a width PW that is perpendicular to the length 286, in certain embodiments the width PW being less than the width 64 of the base 40.

As shown in FIG. 6 and discussed further below, the propulsor 270 is configured to propel the marine vessel 1 through the water in the port-starboard direction PS when the shaft 230 is positioned in the deployed position. It should be recognized that, for simplicity, the propulsor 270 is described as generating propulsion in the port-starboard direction, and thus that the marine vessel moves in the port-starboard direction. However in certain configurations, the propulsor 270 may accomplish this movement of the marine vessel in the port-starboard direction by concurrently using another propulsor coupled elsewhere on the marine vessel 1, for example to provide translation rather than rotation of the marine vessel 1.

It should be recognized that when transitioning the shaft 230 and propulsor 270 from the stowed position of FIG. 3 to the deployed position of FIG. 6, the shaft 230 pivots 90 degrees about the pivot axis PA from being generally horizontal to generally vertical, and the propulsor 270 rotates 90 degrees about the length axis LA of the shaft 230 from the propeller axis PPA being within the fore-aft plane FAP (FIG. 1) to extending in the port-starboard direction PS. The present inventors invented the presently disclosed stowable propulsion devices 30 wherein pivoting of the shaft 230 about the pivot axis PA automatically correspondingly causes rotation of the shaft 230 about is length axis LA without the need for additional actuators (both being accomplished by the same actuator 240 discussed above). With reference to FIGS. 2-3, this function is accomplished through a gearset 90, which as discussed above is formed by the engagement of the stationary gear 92 and moving gear 100.

As discussed above, the stationary gear 92 is fixed relative to the base 40 and the moving gear 100 rotates in conjunction with the shaft 230 rotating about its length axis LA. In this manner, as the shaft 230 is pivoted about the pivot axis PA via actuation of the actuator 240, the engagement between the mesh face 96 of the stationary gear 92 and the mesh face 104 of the moving gear 100 causes the moving gear 100 to rotate, since the stationary gear 92 is fixed in place. This rotation of the moving gear 100 thus causes rotation of the moving gear 100, which correspondingly rotates the shaft 230 about its length axis LA. Therefore, the shaft 230 is automatically rotated about its length axis LA when the actuator 240 pivots the shaft 230 about the pivot axis PA. It should be recognized that by configuring the mesh faces 96, 104 of the gears accordingly (e.g., numbers and sizes of gear teeth), the gearset 90 may be configured such that pivoting the shaft 230 between the stowed position of FIG. 4 and the deployed position of FIG. 6 corresponds to exactly 90 degrees of rotation for the shaft 230 about its length axis LA, whether or not the shaft 230 is configured to pivot 90 degrees between its stowed and deployed positions. It should be recognized that other pivoting and/or rotational angles are also contemplated by the present disclosure.

The present inventors invented the presently disclosed configurations, which advantageously provide for stowable propulsion devices 30 having a minimal width 64 (FIG. 2) when in the stowed position, clearing the way for use of a scissor type lift 20 or other lifting mechanisms for the marine vessel 1, while also positioning the propulsor for generating thrust in the port-starboard direction PS when in the deployed position.

As shown in FIG. 6, certain embodiments include stop 80 within the base 40 for stopping, centering, and/or securing the shaft 230 in the stowed position. In the embodiment shown, a centering slot 86 is defined within the bottom 84 of the stop 80. This centering slot 86 is configured to receive a tab 308 that extends from a clamp 306 positioned at a midpoint along the shaft 230. When the shaft 230 is pivoted and rotated into its stowed position as shown in FIG. 2, the tab 308 of the clamp 306 is received within the centering slot 86 of the stop 80, whereby the bottom 84 of the stop 80 itself prevents further upward pivoting of the shaft 230, and whereby the centering slot 86 prevents lateral movement of the propulsor 270 when in the stowed position.

The embodiment of FIG. 6 further depicts a positional sensor 300 configured for detecting whether the stowable propulsion device 30 is in the stowed position. The positional sensor 300 shown includes a stationary portion 302 and a moving portion 304, whereby the stationary portion 302 is a Hall Effect Sensor positioned adjacent to the centering slot 86 of the stop 80, which detects the moving portion 304 integrated within the tab 308. In this manner, the positional sensor 300 detects when the shaft 230 is properly in the stowed position, and when it is not.

It should be recognized that other positional sensors 300 are also known in the art and may be incorporated within the systems presently disclosed. For example, FIG. 3 depicts an embodiment in which the positional sensor 300 is incorporated within the actuator 240, such as a linear encoder, that can be used to infer the position of the shaft 230 via the position of the extending member 260 of the actuator 240 relative to the stationary portion 246. An exemplary positional sensor 300 is Mercury Marine's Position Sensor ASM, part number 8M0168637, for example.

Figure 9:
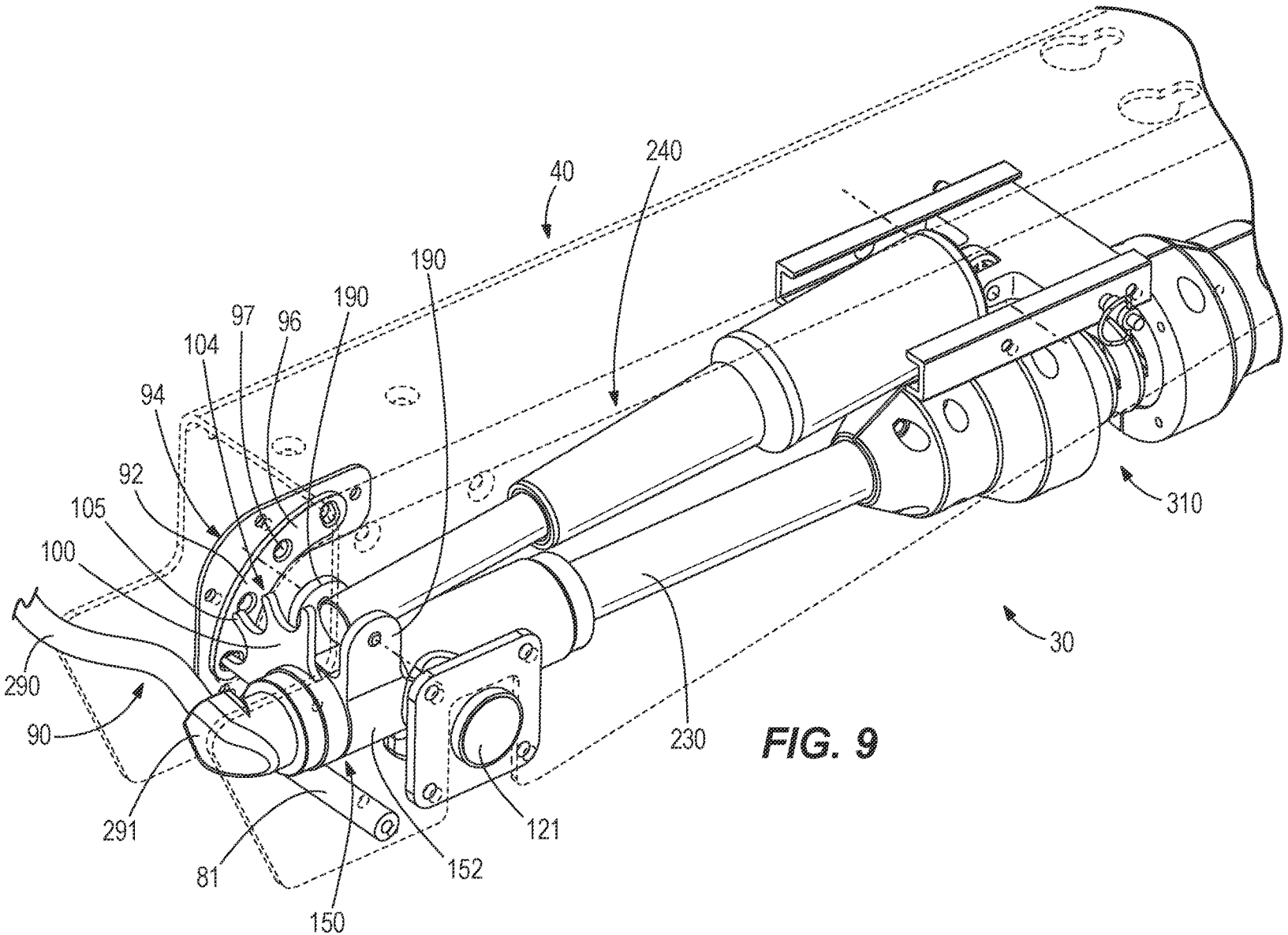
FIG. 9 is an isometric view of an alternate embodiment of propulsion device coupled to a marine vessel and having a propulsor.

The present disclosure contemplates other embodiments of stowable propulsion devices 30. For example, FIG. 9 depicts an embodiment having two pivot arms 190 coupled directly to the main body 152 of the pivot rotation device 150. The actuator 240 is pivotally coupled to the two pivot arms 190 in a similar manner as that discussed above. In certain examples, the two pivot arms 190 are integrally formed with the clamp segments 212 of the first clamp system 210, for example. The gearset 90 of the embodiment in FIG. 9 also varies from that discussed above. Specifically, the mesh face 96 of the stationary gear 92 includes openings 97 rather than gear teeth. These openings 97 are configured to receive fingers 105 that extend from the mesh face 104 of the moving gear 100, generally forming a gear and sprocket type system for the gearset 90. The embodiment shown also includes a stop rod 81 for preventing the shaft 230 from rotating too far, or in other words past the deployed position.

Figure 10:
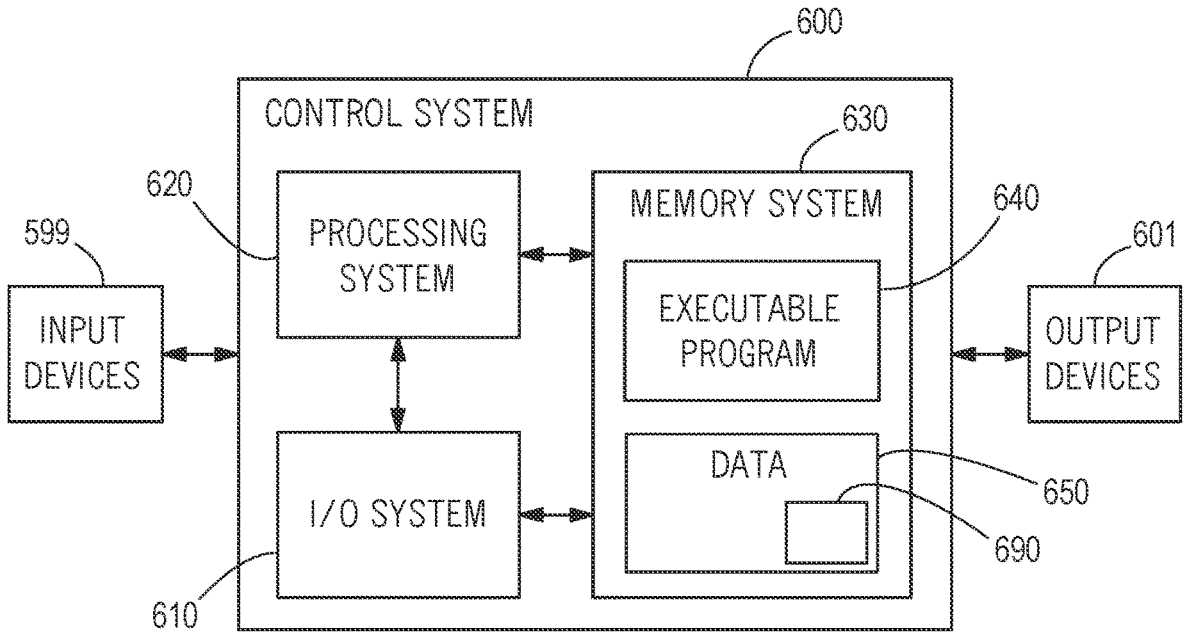
FIG. 10 depicts an exemplary control system for controlling propulsion devices according to the present disclosure.

FIG. 10 depicts an exemplary control system 600 for operating and controlling the stowable propulsion device 30. Certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

In certain examples, the control system 600 communicates with each of the one or more components of the stowable propulsion device 30 via a communication link CL, which can be any wired or wireless link. The control system 600 is capable of receiving information and/or controlling one or more operational characteristics of the stowable propulsion device 30 and its various sub-systems by sending and receiving control signals via the communication links CL.

The control system 600 of FIG. 10 may be a computing system that includes a processing system 610, memory system 620, and input/output (I/O) system 630 for communicating with other devices, such as input devices 599 and output devices 601, either of which may also or alternatively be stored in a cloud 602. The processing system 610 loads and executes an executable program 622 from the memory system 620, accesses data 624 stored within the memory system 620, and directs the stowable propulsion device 30 to operate as described in further detail below.

The processing system 610 may be implemented as a single microprocessor or other circuitry, or be distributed across multiple processing devices or sub-systems that cooperate to execute the executable program 622 from the memory system 620. Non-limiting examples of the processing system include general purpose central processing units, application specific processors, and logic devices. The memory system 620 may comprise any storage media readable by the processing system 610 and capable of storing the executable program 622 and/or data 624. The memory system 620 may be implemented as a single storage device, or be distributed across multiple storage devices or sub-systems that cooperate to store computer readable instructions, data structures, program modules, or other data. The memory system 620 may include volatile and/or non-volatile systems and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example.

The present disclosure further relates to lock devices and methods for preventing a propulsor from pivoting away from a stowed position. The inventors have recognized that propulsion devices presently known in the art do not have incorporate lock devices to safely maintain them in a stowed position. In particular, the inventors have recognized a need to lock the propulsor 270 in the stowed position if the actuator 240 fails and the propulsor 270 must be manually stowed, and/or when marine vessel 1 is trailered (to protect actuator 240 and other components during transit). It is possible to manually tie the propulsor up in the stowed position (e.g., via rope or a bungee cord). However, the present inventors have recognized that these ropes are susceptible to being misplaced, becoming damaged (e.g., fraying or stretching out over time), can be difficult to use (e.g., untying wet rope can be challenging), and/or slide around or risk damage to components due to not having suitable elements for anchoring to the rope.

Figure 11:
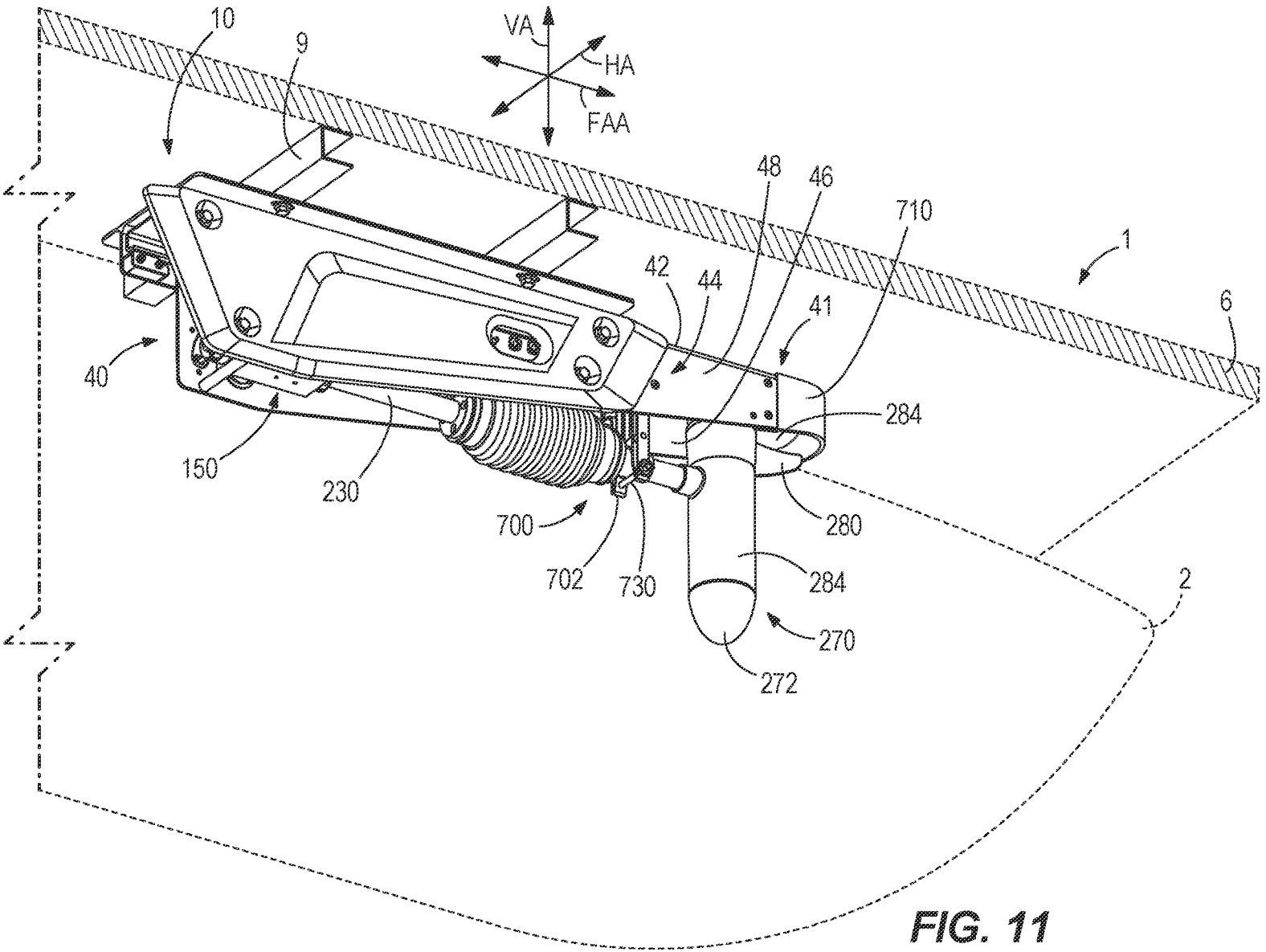
FIG. 11 depicts an isometric bottom-right view of a propulsion device with one embodiment of lock device for preventing a propulsor from pivoting out of a stowed position according to the present disclosure.
Figure 12:
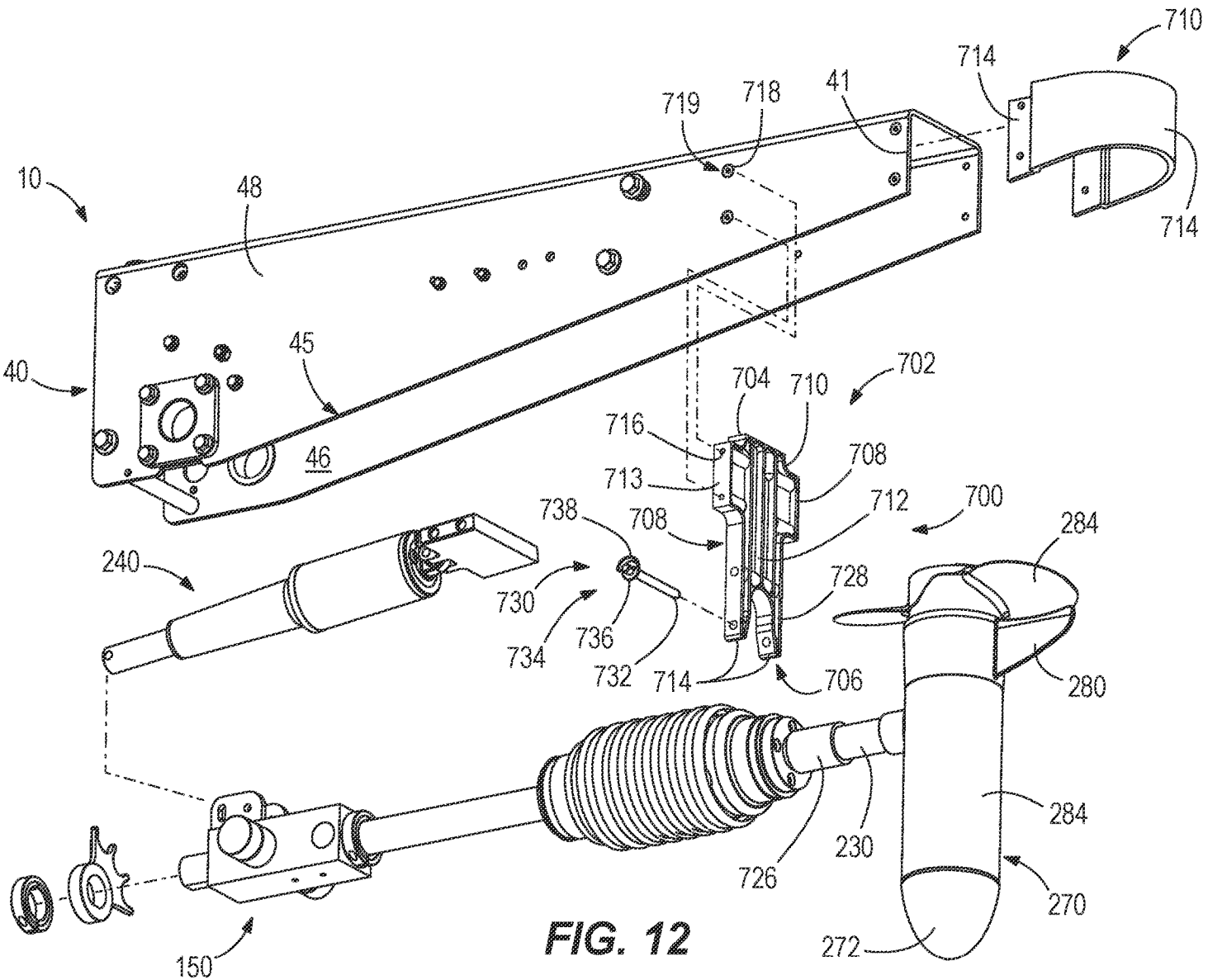
FIG. 12 is an exploded view of the propulsion device of FIG. 11.

FIGS. 11 and 12 depict a propulsion device 700 having some of the components discussed above, but also incorporating a lock device 700 for preventing the propulsor 270 from pivoting away from the stowed position. As previously discussed, the base 40 has sides 44 that extend downwardly from the deck 6 of the marine vessel 1. The sides 44 each extend from a top 42 to a bottom 45 and have an inward side 46 and opposite outward side 48. An endcap 710 is provided at the front 41 of the base 40, in this case with mounting ends 712 of the endcap 710 being coupled to the base 40 with a forward end 714 curving forwardly in an arc. The propulsor 270 is pivotally coupled to the base 40 to be pivotable in tune between a deployed position as discussed above, as well as a stowed position as shown in FIG. 11.

A pivot rotation system 150 is provided in the manner described above, which allows for rotation of the propulsor 270 about a shaft 230 coupling the propulsor 270 to the base 40 while the shaft 230 pivots between the deployed and stowed positions. The shaft 230 pivots about an axis parallel to a horizontal axis HA, which is perpendicular to a vertical axis VA and perpendicular to a fore-aft axis FAA. It should be recognized that the present disclosure also contemplates propulsion devices 10 with lock devices 700 for configurations in which the propulsor 270 does not both pivot and rotate between stowed and deployed positions.

As shown in FIG. 12, the propulsor 270 includes a main body 284 coupled to the shaft 230, as well as a nose cone 272 opposite the propeller 284, as discussed above. A fin 280 (also referred to as a skeg) is provided along the main body 284 and extends therefrom to a lower edge 281 (see FIG. 21). The fin 280 protects the propeller 284 from impacts forces caused by striking an underwater object in a manner known in the art.

Figure 13:
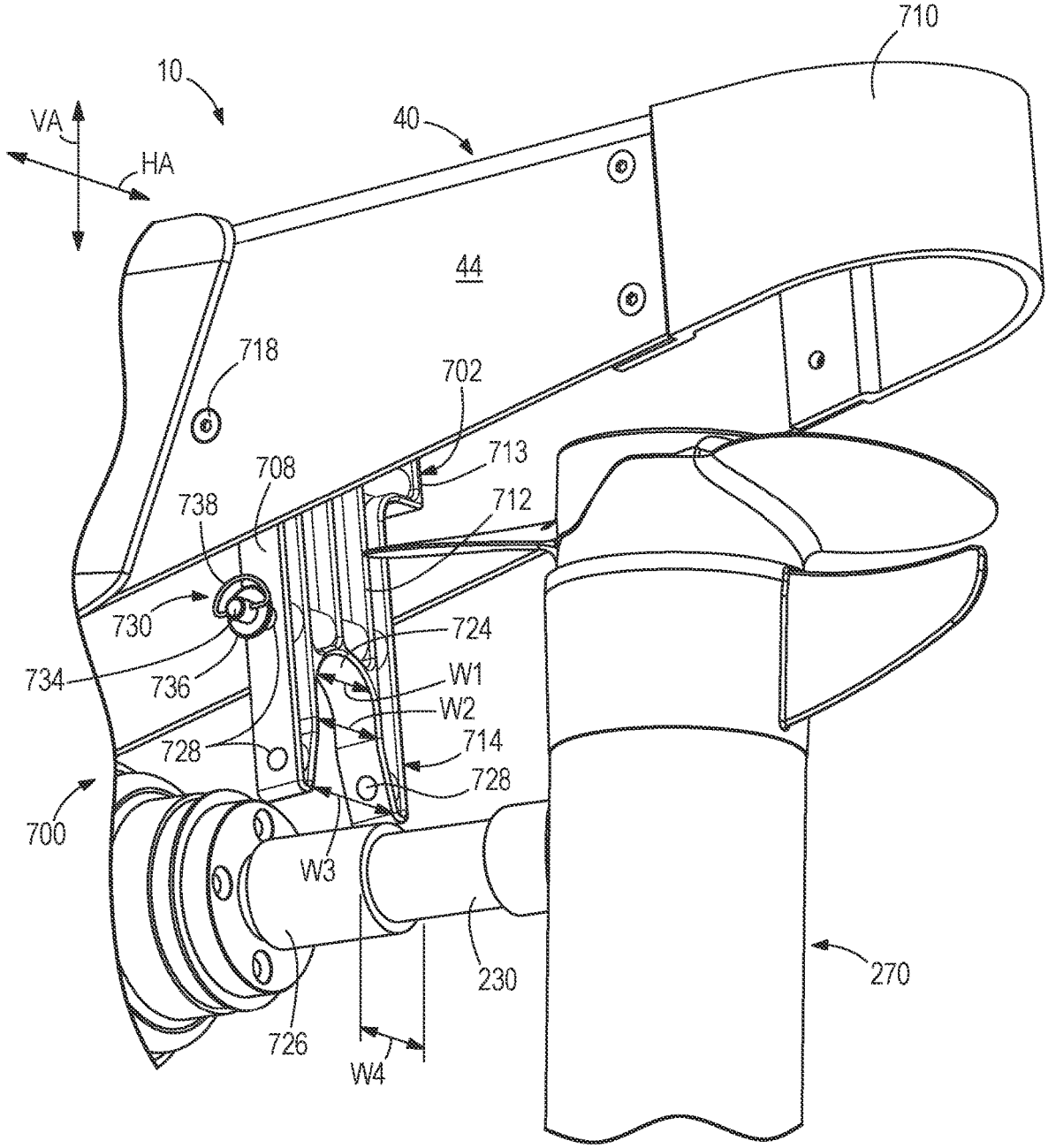
FIG. 13 is a close-up view of the propulsion device of FIG. 11 approaching the stowed position.

As shown in FIGS. 12 and 13, the lock device 700 includes a bracket 702 and rigid member, here a pin 730, that engages therewith. The bracket 702 extends between a top 704 and bottom 706, between sides 708, and between a front 710 and back. Extensions 713 protrude outwardly from the sides 708 and have openings 716 therein. The bracket 702 further includes a base 712 with arms 714 extending downwardly therefrom. An inner contour 724 is defined along the bottom 706 between the arms 714, which in this case is generally circular to correspond to the shape of the shaft 230 to be received therein.

The brackets 702 is coupled to the sides 44 of the base 40 via fasteners 718, which are received through openings 719 in the base 40 and the openings 716 in the extensions 713 of the sides 708 of the bracket 702. The fasteners 718 may be threaded fasteners such as nuts and bolts or screws, be rivets, welds, adhesives, and/or the like. Additional openings 728 are provided through the arms 714, in the present example having an upper pair and a lower pair along the length between the top 704 and the bottom 706 of the bracket 702. The openings 728 are configured to receive the pin 730 therein.

With continued reference to FIG. 12, the pin 730 extends between the first end 732 and a second end 734. In the example shown, a stop 736 is provided substantially near the second end 734 to limit how far the pin 732 may be inserted within the opening 728 of the bracket 702. Likewise, a ring 738 is provided at the second end 734 to aid the operator in grasping the pin 730 for removal or insertion into the bracket 702 in a manner described further below. A rope or cable may also be tied to the ring 738 to tether the pin 730 to the propulsion device 10 or marine vessel more generally to prevent misplacement of the pin 730.

Figure 14:
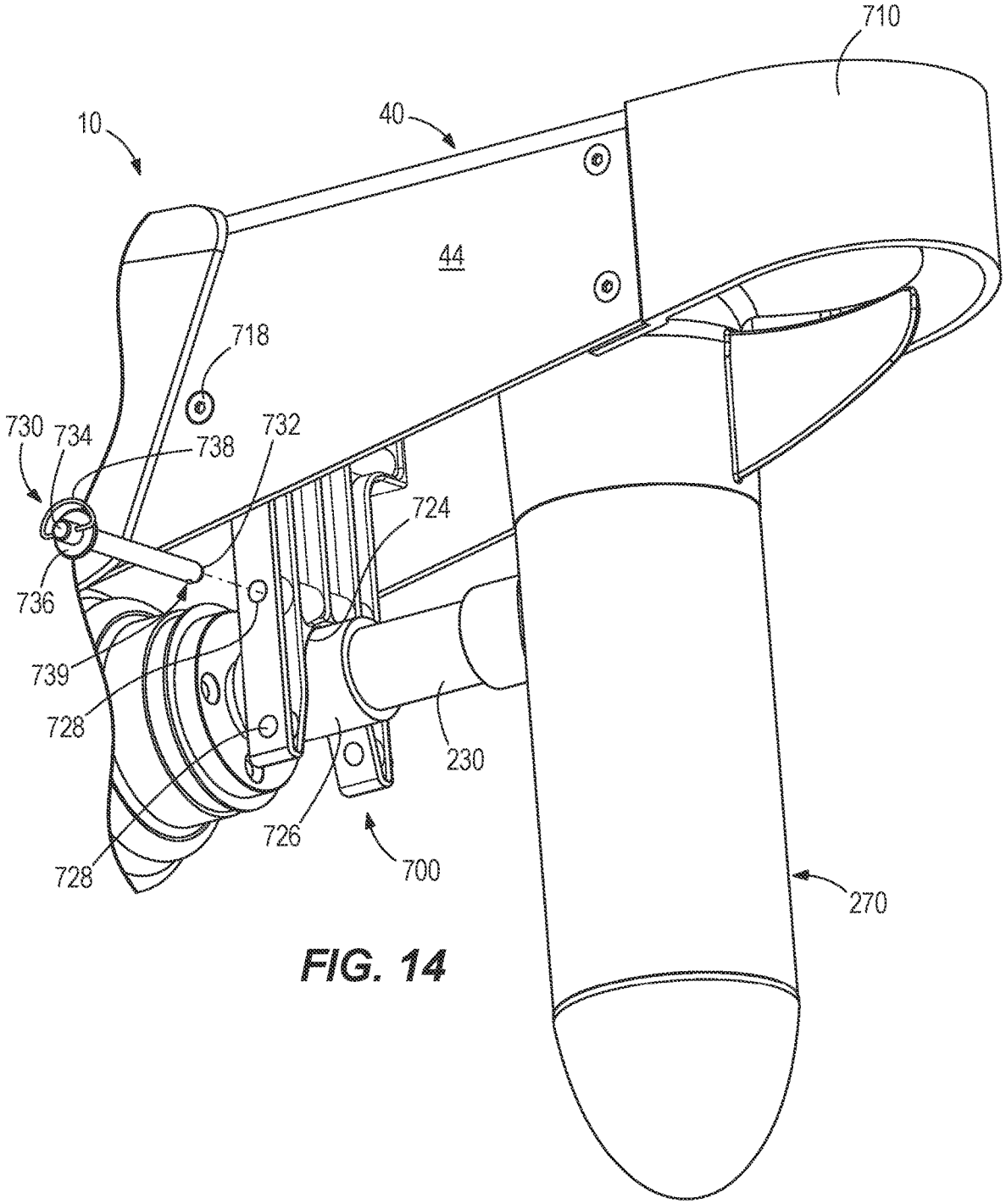
FIG. 14 shows the propulsion device of FIG. 13 in the stowed position without a lock device engaged.
Figure 15:
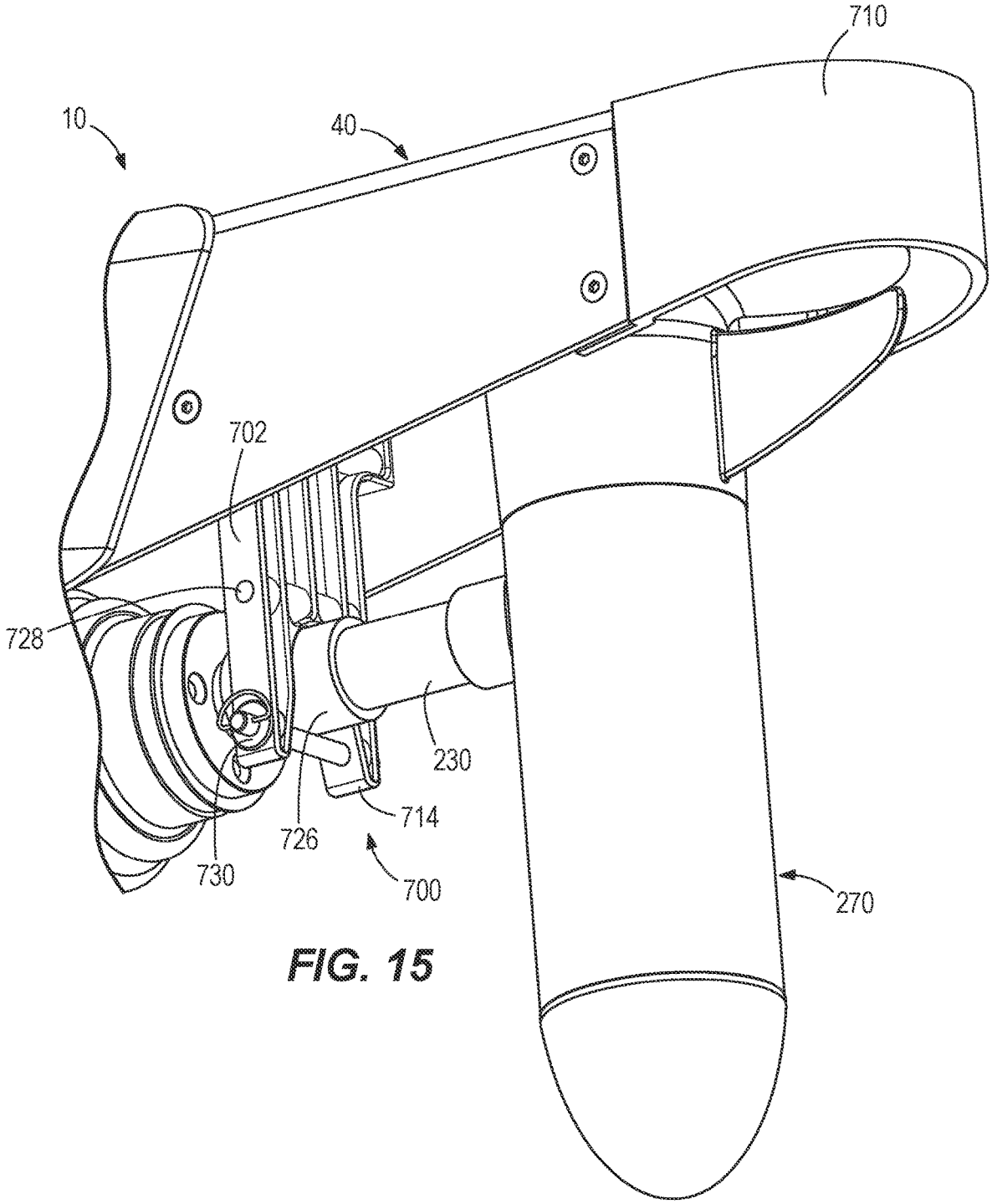
FIG. 15 shows the propulsion device of FIG. 14 with the lock device engaged.

FIG. 13-15 depict the lock device 700 with the propulsor 270 nearing the stowed position in FIG. 13, in the stowed position but with the lock device 700 disengaged in FIG. 14, and in the stowed position with the lock device 700 engaged in FIG. 15. As shown in FIG. 13, a resilient sleeve 726 is positioned on a portion of the shaft 230, which may be formed of rubber or a polymer, for example. The resilient sleeve 726 provides quiet, non-damaging engagement of the shaft 230 within the lock device 700, and particularly to buffer the contact between the shaft 230 and the inner contour 724 of the bracket 702. In certain embodiments, the resilient sleeve 726 is further configured to provide a press-fit engagement between the shaft 230 and the inner contour 724, in particular with the inter contour 724 having a first width W1 when the propulsor 270 is in the fully stowed position that is slightly greater than a second width W2, whereby the resilient member 726 must slightly compress (relative to its uncompressed, fourth width W4) to move past the second width W2 when the propulsor 270 is moving into the stowed position. The entrance to the inner contour 724 also has a third width W3 that is greater than both the first width W1 and second width W2, assisting in funneling or aligning and the shaft 230 within the lock device 700.

FIG. 13 further shows the locking pin 730 being stored in an upper pair of openings 724 extending through the bracket 702. The pin 730 does not prevent the propulsor 270 from pivoting away from the stowed position while inserted in this upper pair of openings 728. This provides for safe keeping of the pin 730 so it does not become lost or damaged when the lock device 700 is disengaged as shown.

FIG. 14 shows the pin 730 withdrawn from the upper opening 728 through the bracket 702. The pin 730 further includes a detent 739 provided near the first end 732 of the pin 730, for example a spring-loaded ball that extends outwardly to resist the pin 730 from starting to be withdrawn from the bracket 702 (whereby the detent 739 extends outwardly from beyond the opposing side 708 of the bracket 702 when the pin 730 is fully seated). The propulsor 270 is now shown in the stowed position.

FIG. 15 shows the pin 730 reinserted into the bracket 702, whereby the pin 730 (as the ridged member) is now positioned below the shaft 230 to prevent the propulsor 270 from pivoting away from the stowed position. The lock device 700 can be again disengaged by withdrawing the pin 730 from the openings 728 in the bracket 702, allowing the propulsor 270 to then be deployed.

Figure 17:
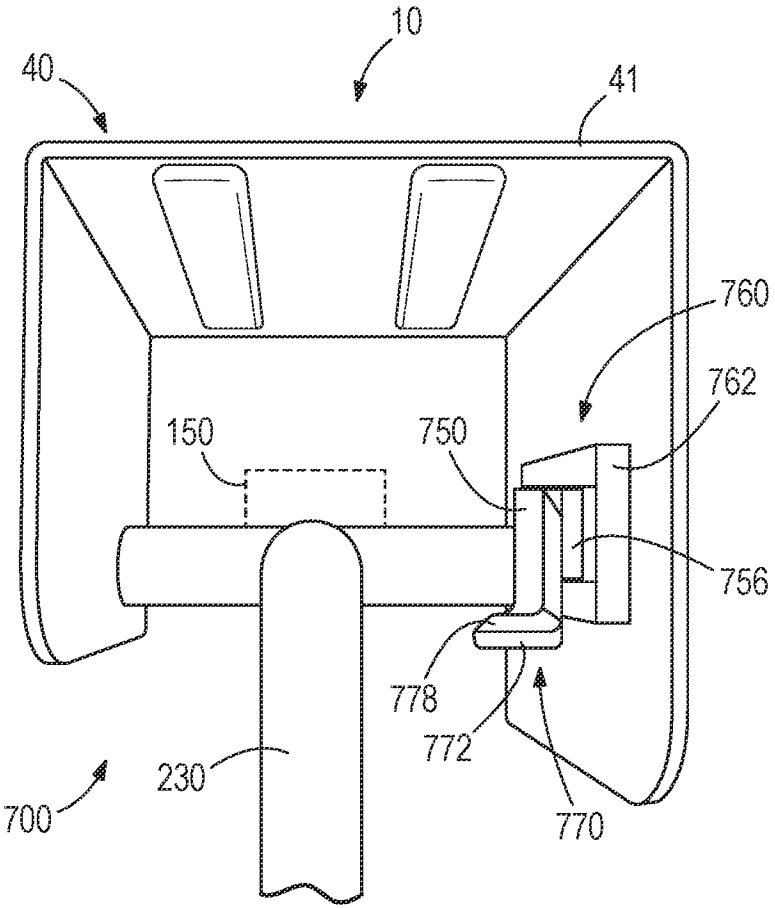
FIGS. 16-17 are front views of another embodiment of lock device according to the present disclosure engaged and disengaged, respectively.
Figure 16:
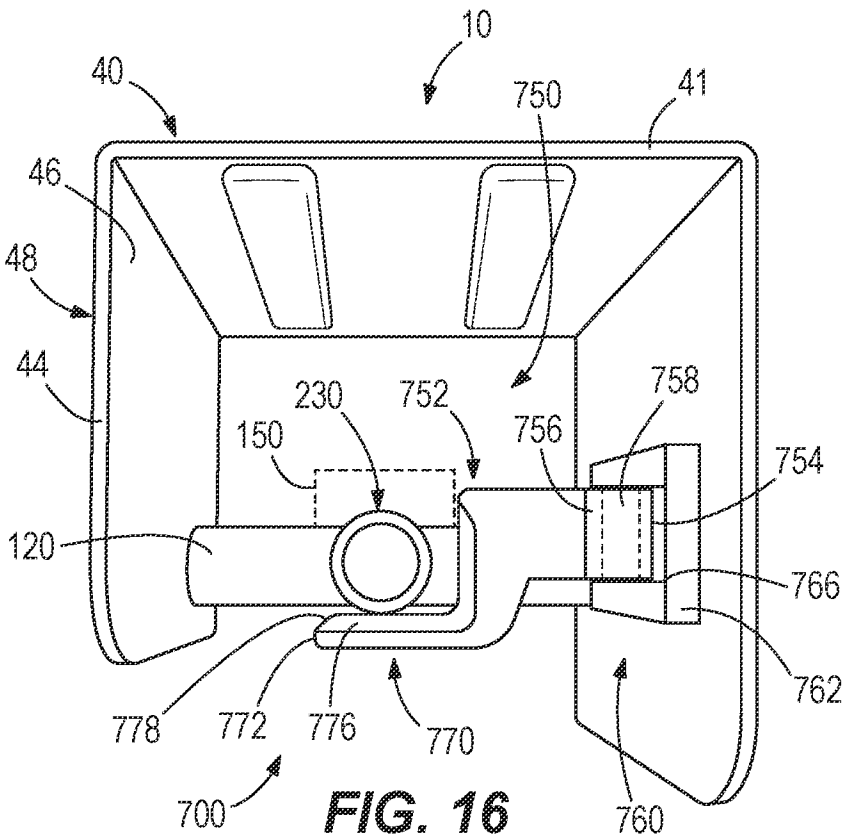

FIGS. 16 and 17 are front views of another embodiment of lock device 700 that when engaged (or in the locked position) prevents the propulsor from pivoting away from the stowed position, again by supporting the shaft 230 from below. In this embodiment, the rigid member is a body 750 that is pivotally coupled to the base 40 via a hinge 760. The body 750 extends between a distal end 752 and a base end 754, with a barrel 756 positioned near the base 754 having an opening therethrough. The hinge 760 includes a base mount 762 configured to be coupled to the base 40, for example using fasteners, welds, adhesives, rivets, and such or the like. The hinge 760 further includes an axle 758 configured to be received within the opening of the body 750 such that the body 750 may pivot about the axle 764. A lower arm 770 extends away from the body 750 to a distal end 772. A ramp 778 angles upwardly from the distal end 772 to a floor 776 that is perpendicular to the distal end 772. The shaft 230 rests upon the floor 776 when the lock member 700 is engaged as shown in FIG. 16. The ramp 778 assists with aligning the shaft 230 within the lock member 700 as the body 750 is rotated. In this manner, the body 750 and the lower arm 770 are pivotable relative to the base 40 to engage and disengage the lock device 700, which prevents the propulsor 270 from pivoting away from the stowed position by engagement with the shaft 230.

Figure 19:
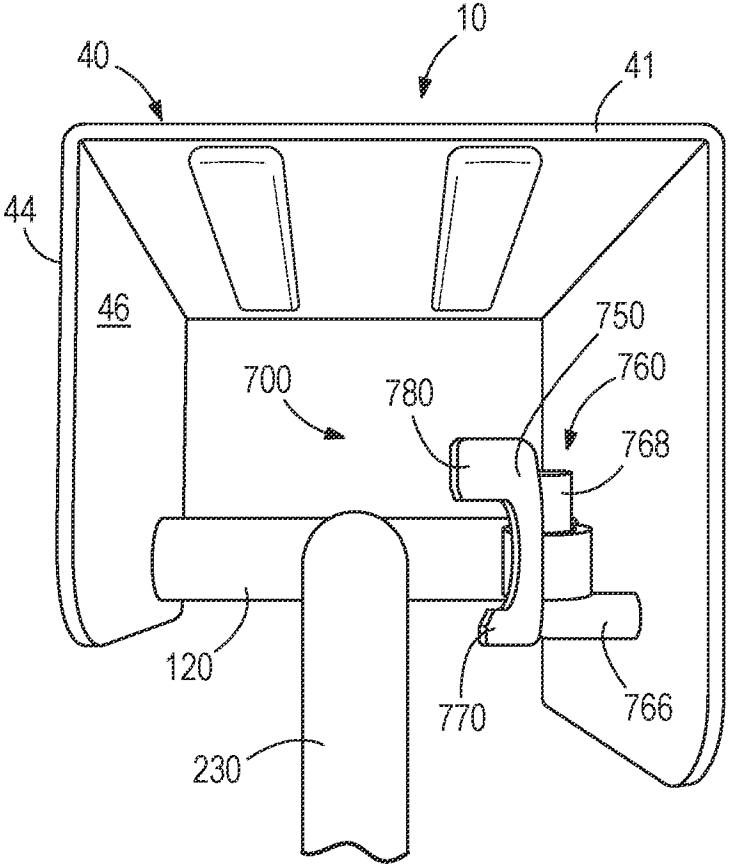
FIGS. 18-19 are front views of another embodiment of lock device according to the present disclosure engaged and disengaged, respectively.
Figure 18:
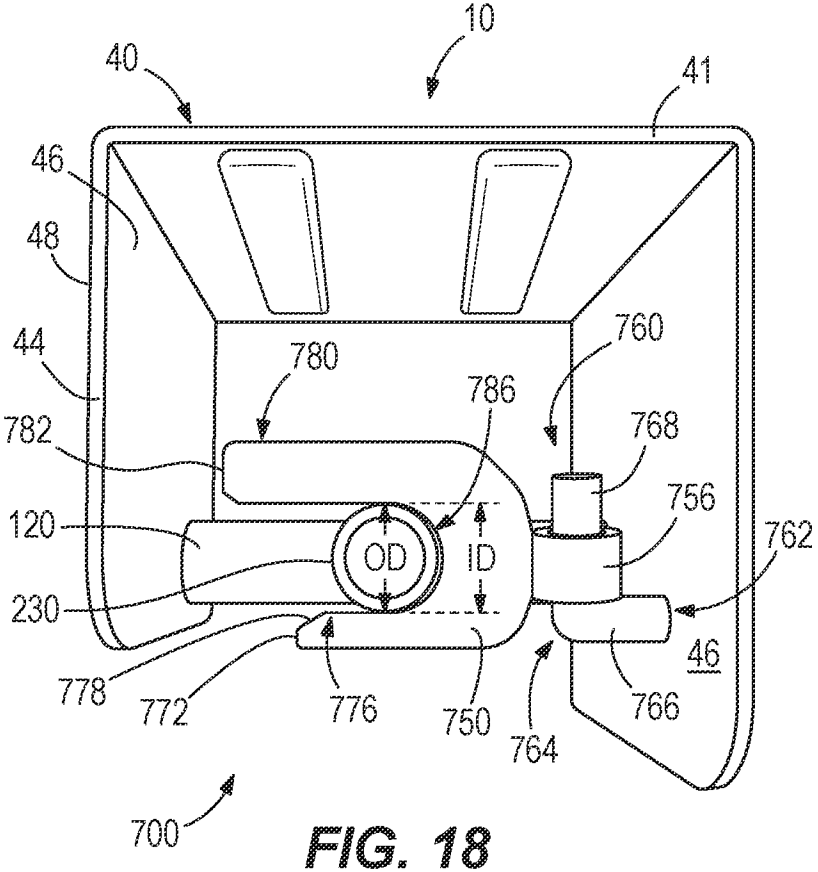

Another lock device 700 is shown in FIGS. 18 and 19, whereby in addition to the lower arm 770, an upper arm 780 is coupled to the body 780 and extends outwardly to a distal end 782. An inner contour 786 is defined between the lower arm 770 and upper arm 780, in the present example having an inner diameter ID corresponding to the outer diameter OD of the shaft 230. The shaft 230 thus engaged with the inner contour 786 when the body 750 of the lock device 700 is pivoted away from the base 40. In this manner, the upper arm 780 prevents the shaft 230 from further moving in an upward direction when the lock device 700 is engaged. This further protects elements of the propulsion device 10 from damage caused by the propulsor 270 bouncing up, for example when transporting on a trailer.

The lock device 700 of FIGS. 18 and 19 further depicts an alternate hinge 760 relative to the hinge 760 shown in FIGS. 16-17. In this embodiment, the axle 764 is formed by a an arm 766 that extends outwardly from the base 40, whereby a post 768 extending upwardly from the arm 766 (here being at 90 degree angles to each other). The arm 766 may be welded, integrally formed with, or otherwise coupled to the base 40 in a manner presently known in the art. Likewise, the post 768 may be integrally formed with, or coupled to, the arm 766.

Figure 20:
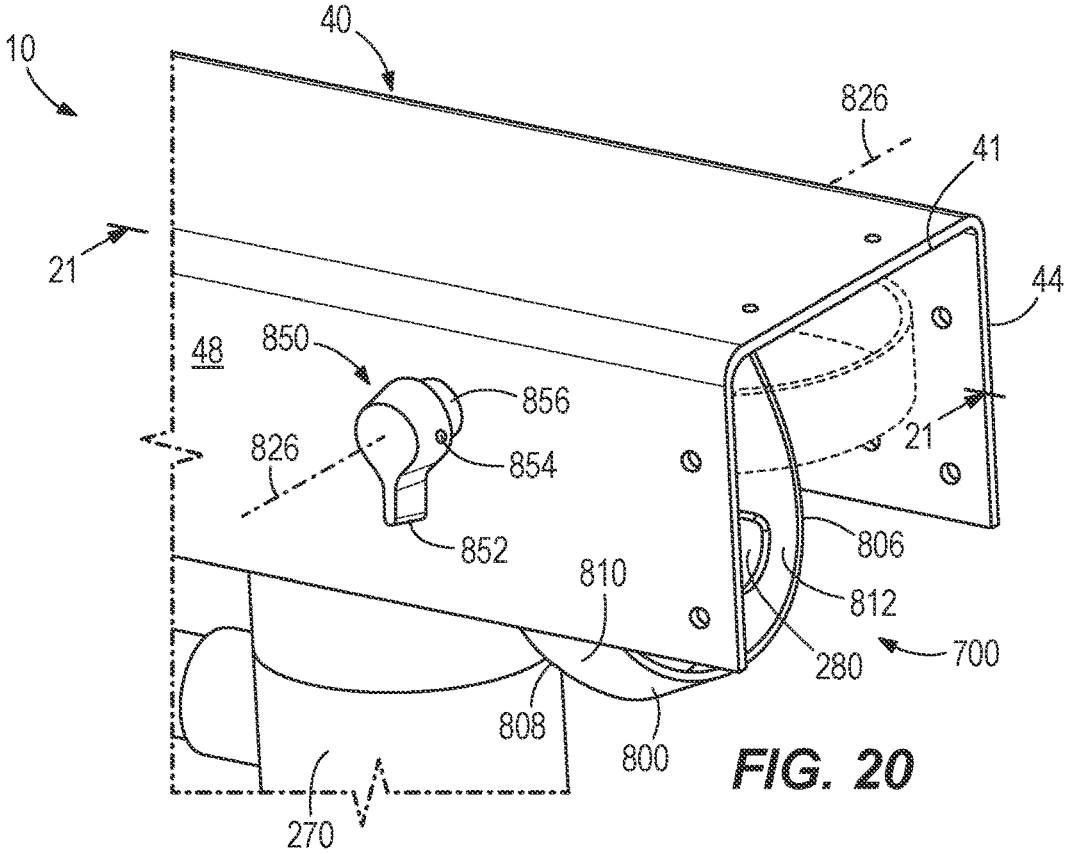
FIG. 20 is a front perspective view of another embodiment of lock device according to the present disclosure.
Figure 21:
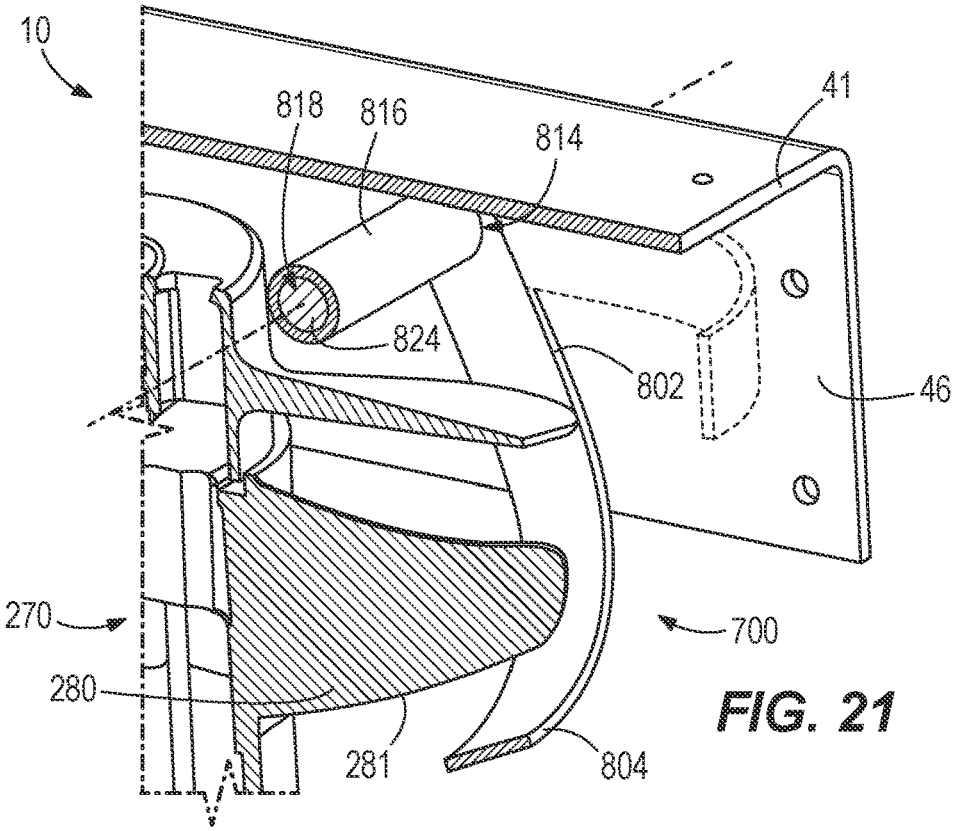
FIG. 21 is a sectional view taken along the line 21-21 in FIG. 20.
Figure 22:
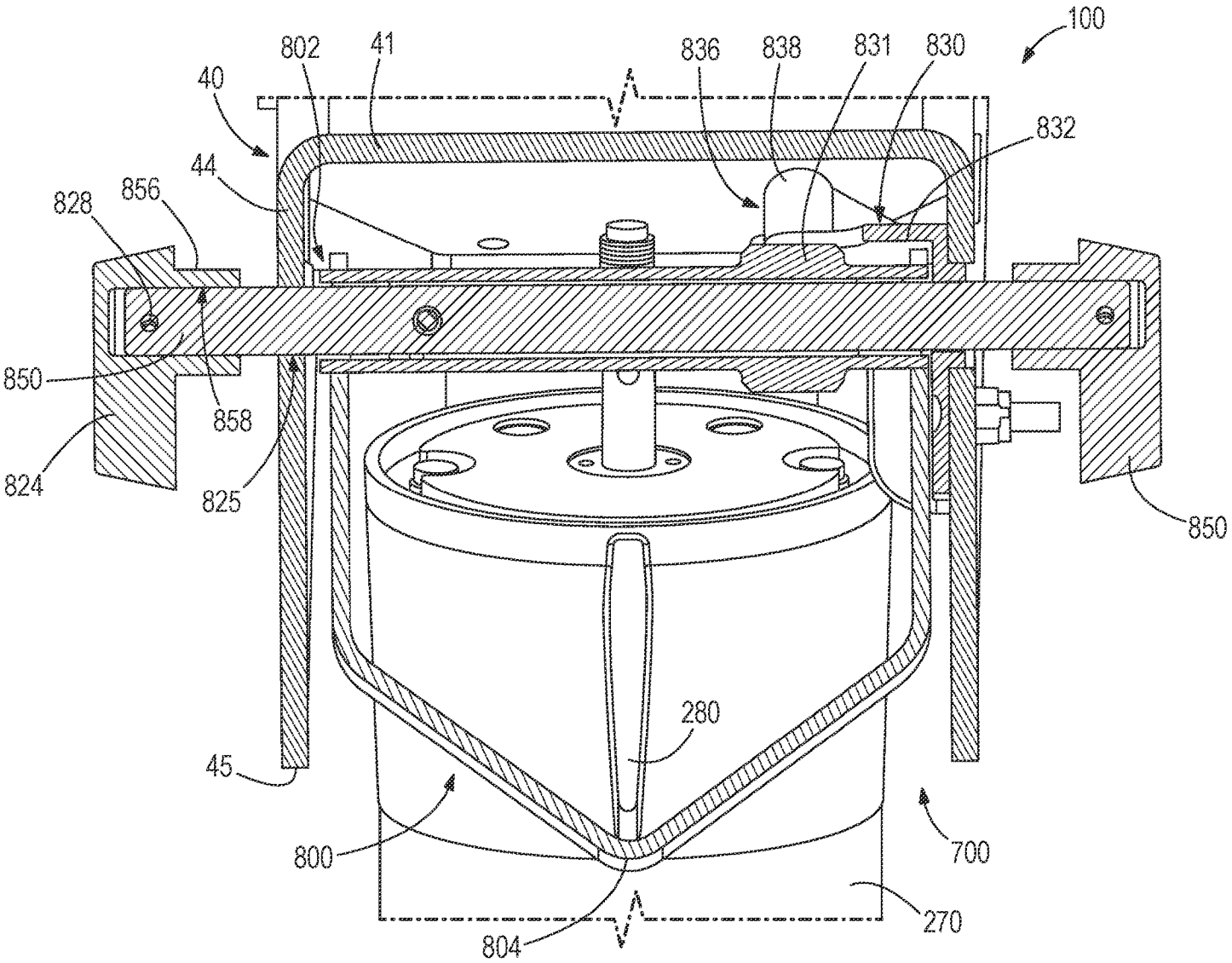
FIG. 22 is a front sectional view of the propulsion device of FIG. 20.

FIGS. 20-22 depict another embodiment of lock device 700 for preventing the propulsor 270 from pivoting away from the stowed position, now through engagement with the fin 280 or skeg. The lock device 700 includes a hook 800 having opposing sides 802 that meet together at an end 804, the end 804 aligning with the fin 280. The hook 800 also extends between a first edge 806 and second edge 808 and has an outside surface 810 and an inside surface 812. The hook 800 is pivotally coupled at first ends 814 thereof to the base 40. A barrel 816 extends between the first ends 814 of the sides 802 and has an axle opening 825 extending therethrough. The barrel 816 may be coupled to sides 802, or integrally formed therewith.

As shown in FIG. 22, a lock axle 824 extends through the axle opening 725 of the hook 800 and is rotatably fixed to the hook 800 using a mechanism known in the art, such as set screws, adhesives, welds, or other techniques presently known in the art. Inventors—are there particular materials we can cite for the hook 800 or other parts? The lock axle 824 extends through openings in the sides 44 of the base 40 such that the lock axle 824 and hook 800 may pivot together about a pivot axis 826 centered through the lock axle 824.

With reference to FIGS. 20 and 22, a handle 850 has a grip 852 and a barrel 856 defined therein. The handle 850 is rotatably fixed to the lock axle 824 via a set screw 854 received through the handle 850 before extending into an opening 828 within the lock axle 824. In this manner, rotation of the handle 850 by the operator from outside of the base 40 causes the hook 800 to rotate about the pivot axis 826, thereby pivoting the hook 800 under the fin 280 to engage the lock device 700. This prevents the propulsor 270 from pivoting away from the stowed position. The lock device 700 is then disengaged by rotating the hook 800 upwardly, away from the fin 280.

Figure 23:
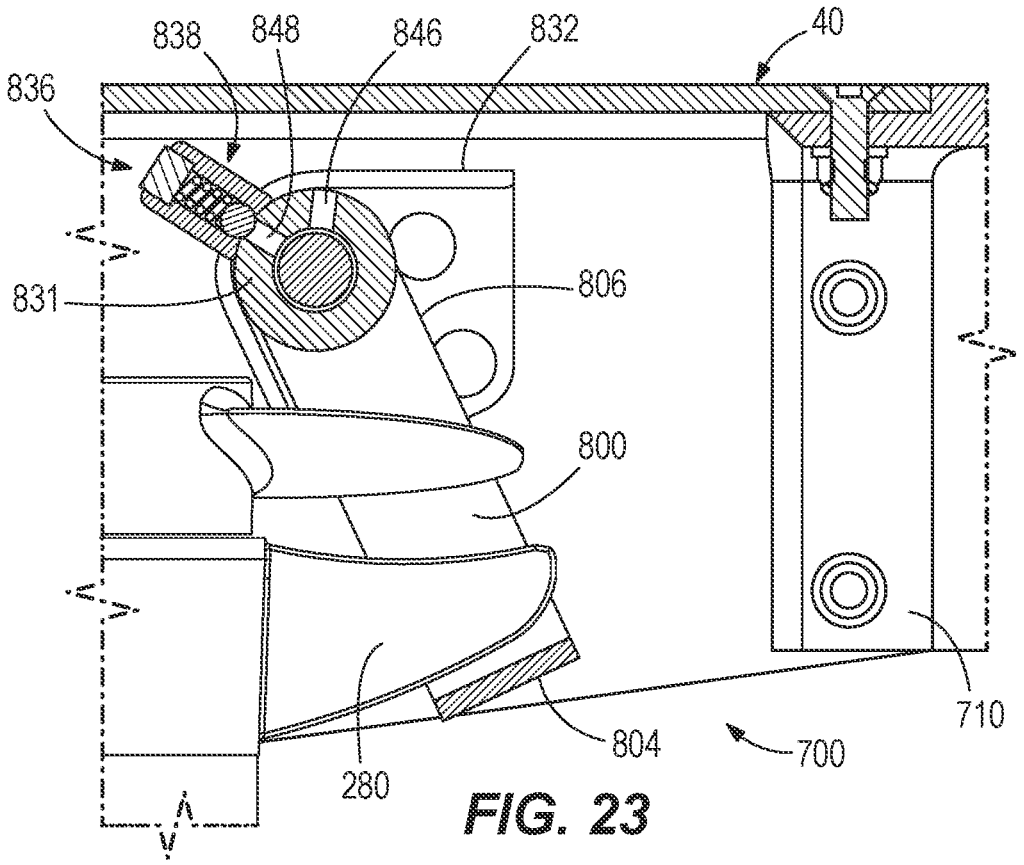
FIGS. 23-24 are sectional side views of the propulsion device of FIG. 20 with the lock device retained in engaged and disengaged positions, respectively.
Figure 24:
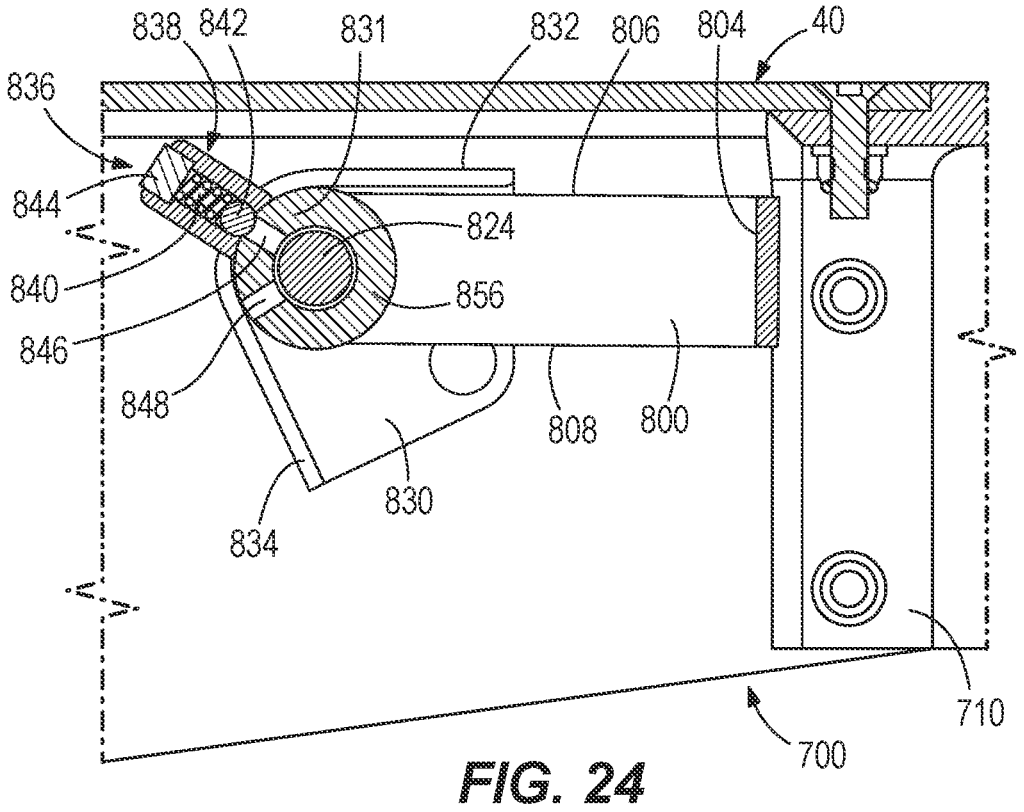

As shown in FIGS. 23 and 24, a limit member 830 may also be provided to limit the rotational range of motion for the hook 800 relative to the base 40. The limit member 830 has an upper stop 832 that limits the rotation of the hook 800 by engagement with the first edge 806 thereof, and a lower stop 834 that limits downward rotation of the hook 800 by engagement with the second edge 808 thereof. The upper stop 832 and lower stop 834 extend perpendicularly from the inward surface 46 of one of the sides 44 and may be coupled to the base 40 via adhesives, welds, rivets, fasteners, and/or other methods presently known in the art.

FIGS. 23 and 24 further depict an engagement lock 836 that retains the hook 800 in either the engaged or disengaged position. In particular, the engagement lock 836 includes a detent 838 having a spring 840, ball 842, and cap 844 as conventionally known in the art. The detent 838 is non-rotatable relative to the base 40, for example being fixed to the limit member 830. A first opening 846 is defined within a number 831 rotatable with the hook 800, as well as the second opening 846. In this manner, the detent 838 engages with the first opening 846 to retain the hook 800 in the disengaged position for the lock device 700 such as shown in FIG. 24, and engages with the second opening 848 to retain the hook 800 in the engaged position for the lock device 700 as shown in FIG. 23. Thus, the detent 838 generally retains the hook 800 in the desired position until a rotation force is provided by the handle 850.

Figure 26:
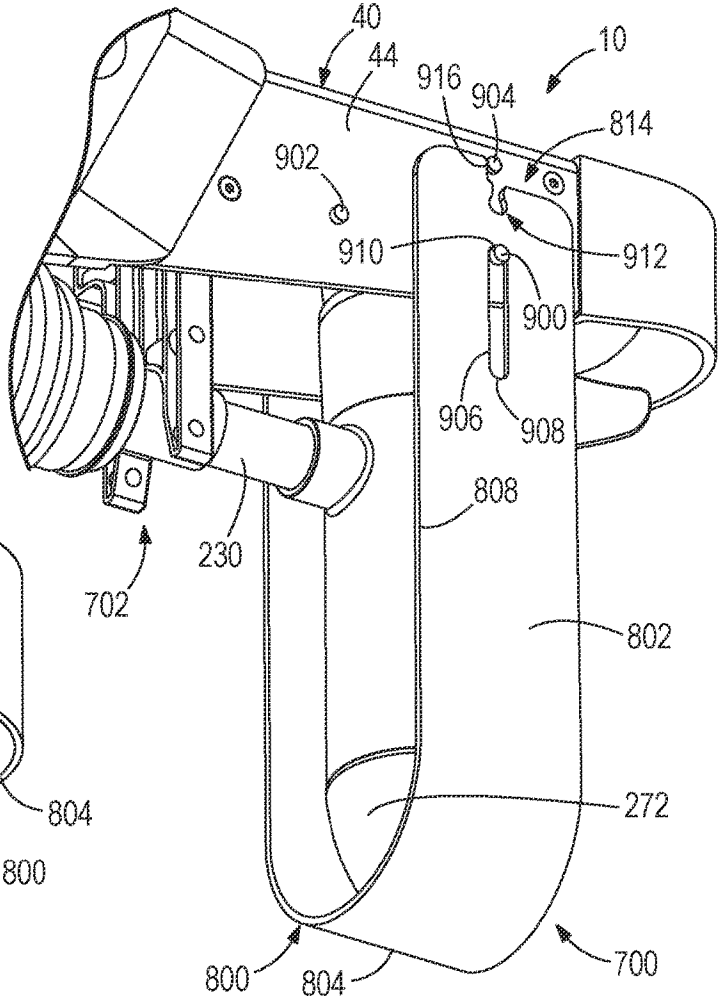
FIGS. 25-26 are side views of another embodiment of a lock device according to the present disclosure in disengaged and engaged positions, respectively.
Figure 25:
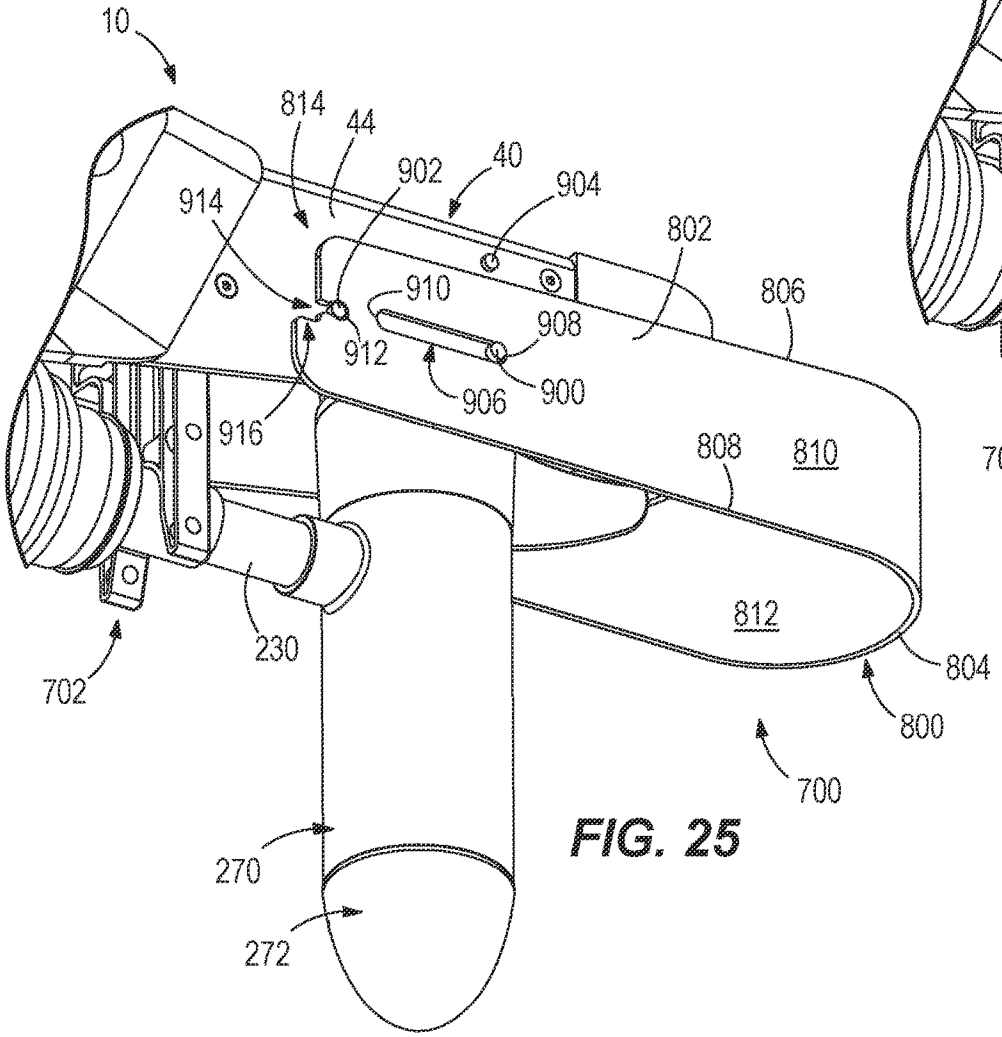

FIGS. 25 and 26 depict another lock device 700 for preventing the propulsor 270 from pivoting away from the stowed position, now by supporting or engaging with the nose cone 272 of the propulsor 270. The lock device 700 includes a hook 800 having similar characteristics to that discussed above, including having sides 802 that extend from first ends 814 to a second end 804, having a first edge 806 and a second edge 808, and having an outside surface 810 and an inside surface 812. A third edge 912 and fourth edge 916 are also defined near the first ends 814 of the hook 800.

The hook 800 further includes a slot 906 defined in one of both of the sides 802 substantially near the first ends 814. For simplicity, the slot 906 will presently be described as singular. The slot 906 extends from a first end 908 to a second end 910. A first pin 900 extends outwardly from the outward surface 48 of the side 44 of the base 40. The slot 906 is configured to receive the first pin 900 therein. In this manner, the hook 800 is slidable and pivotable with the slide pin 800 extending through the slot 906.

Additionally, a second pin 902 and a third pin 904 extend outwardly from the outward surface 48 of the base 40, which selectively engaged with the hook 800 to retain the hook 800 in the engaged or disengaged positions. As shown in FIG. 25, the hook 800 may be pivoted upwardly and translated rearwardly (e.g., towards the base 40) such that the second pin 902 engages with the third edge 912 defined near the first end 814 of the hook 800 to prevent the hook 800 from pivoting downwardly. In certain embodiments, the third edge 912 has a generally circular contour that corresponds to the shape of the second pin 902. Specifically, a narrowed opening 914 is provided as an entrance to the third edge 912. In this configuration, to seat the second pin 902 in the third edge 912 to lock the hook 800 in the disengaged position. Likewise, force is required to disengage the second pin 902 to again move the hook 800.

With reference to FIG. 26, the fourth edge 916 is generally linear and approximately parallel to the second edge 808 of hook 800. In this manner, engagement between the third pin 904 and the fourth edge 916 of the hook 800 prevents further downward rotation of the hook 800, which is generally maintained in position through the assistance of gravity. Moreover, the mass of the propulsor 270 supported on the hook 800 assists and maintains in retaining the orientation of the hook 800 relative to the base 40.

Figure 27:
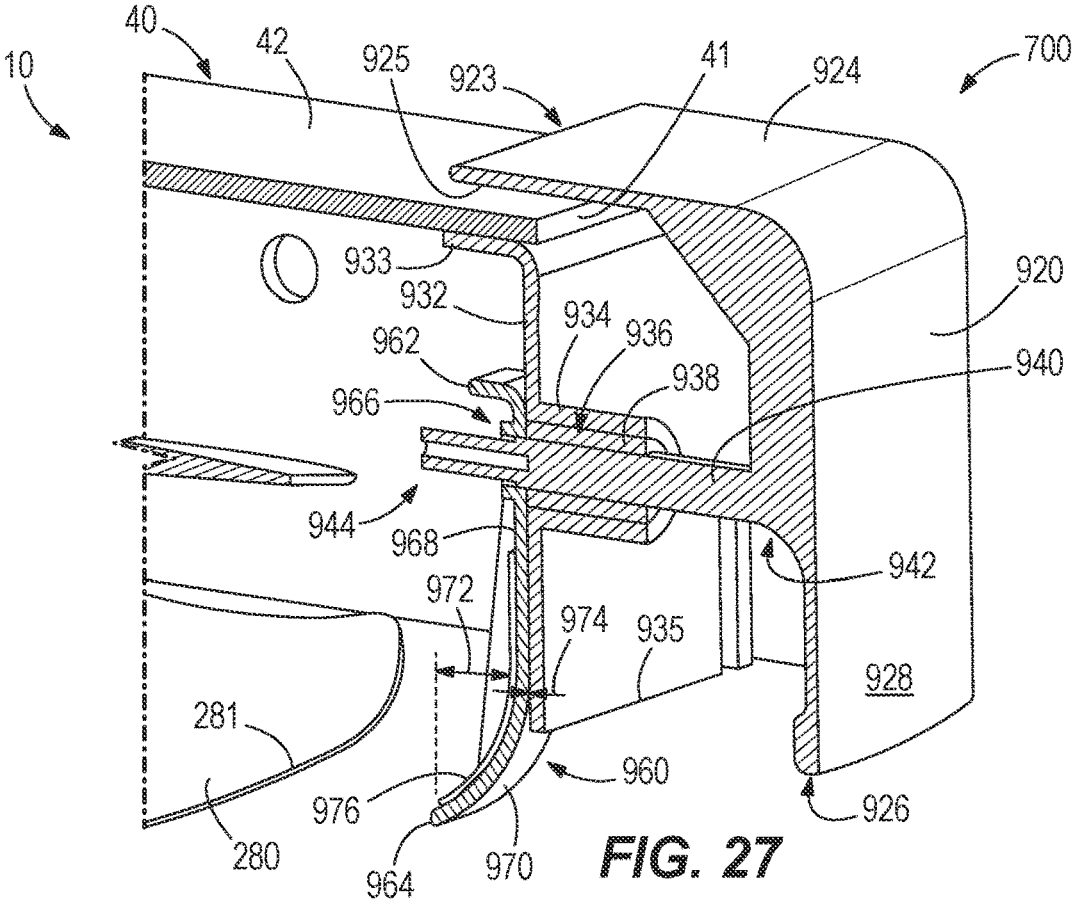
FIGS. 27-28 are sectional side views of another embodiment of a lock device according to the present disclosure in disengaged and engaged positions, respectively.
Figure 28:
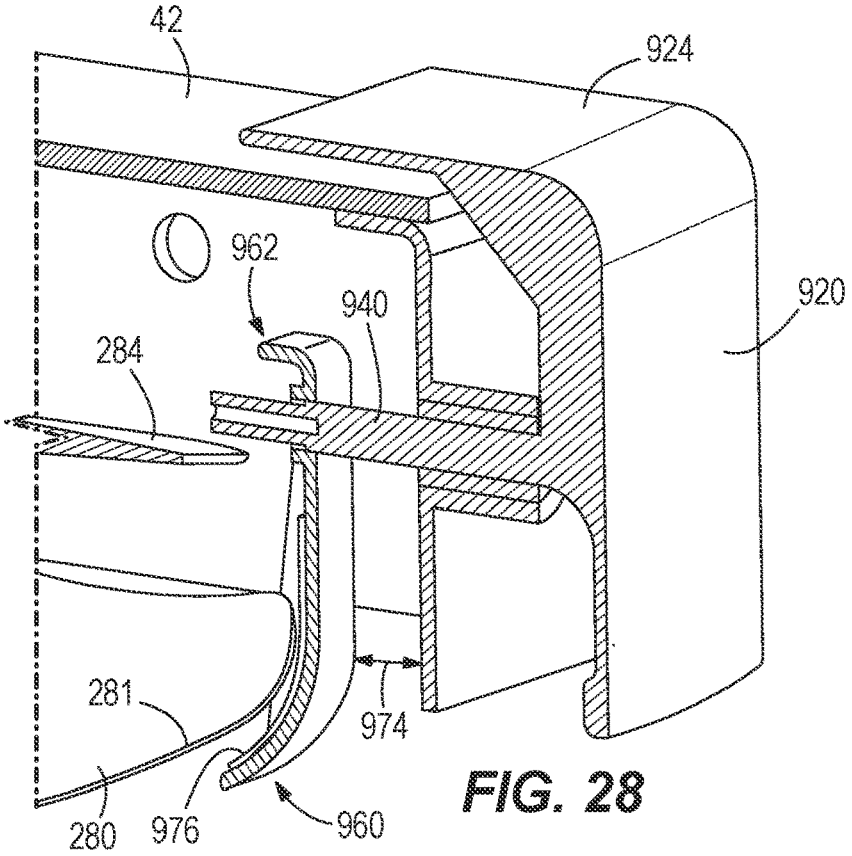

FIGS. 27 and 28 depict another lock device 700 according to the present disclosure, now engaging with the fin 280 to prevent the propulsor 270 from pivoting away from the stowed position. A sliding member 920 has an upper arm 923 at the a top 924 and extends downwardly to a bottom 926 with a front 928 therebetween. An underside 925 of the upper arm 923 of the sliding member 920 rests and slides upon the top 42 of the base 40.

An end plate 932 having a top 933 and a bottom 935 is coupled to the base 40. A barrel 934 extends forwardly from the end plate 932 and has an opening 936 defined therethrough, which in the present example has a bushing 938 received therein. A plunger 940 extends rearwardly from the sliding member 920 and extends between a first end 942 and a second end 944. The plunger 940 is received through an opening in the bushing 938 and thus through the end plate 932. In this manner. sliding the sliding member 920 towards the end plate 932 results in the plunger 940 moving inwardly relative to the base 40.

With continued reference to FIGS. 27 and 28, a hook 960 extends between a first end 962 and a second end 964, an inside surface 968 and outside surface 970 extending therebetween. An opening 966 is defined through the hook 960, in this embodiment closer to the first end 962 thereof. The second end 964 of the hook 960 curls away from the front 928 of the sliding member 920 by a depth 972. The plunger 940 of the sliding member 920 is received through the opening 966 in the hook 960 and coupled thereto with a fastener, which may be a nut, adhesive, press-fit arrangement, or via other methods known in the art. The hook 960 is shaped to correspond to the lower edge 281 of the fin 280. In this manner, sliding of the sliding member 920 also moves the hook 960 relative to the fin 980 such that pressing the sliding member 920 towards the base 940 causes engagement between the hook 960 and the fin 280. Likewise, withdrawing the sliding member 920 from the base 40 disengages the lock device 700 by removing the hook 960 from engagement with the fin 280. In certain embodiments, such as that shown in FIG. 28, a bumper 976 is provided along the inside surface 961 of the hook 960, which provides padding and prevents noise or damage caused by engagement between the hook 960 and the fin 280 (including movement while the marine vessel 1 is in transit, for example on the road).

Figure 29:
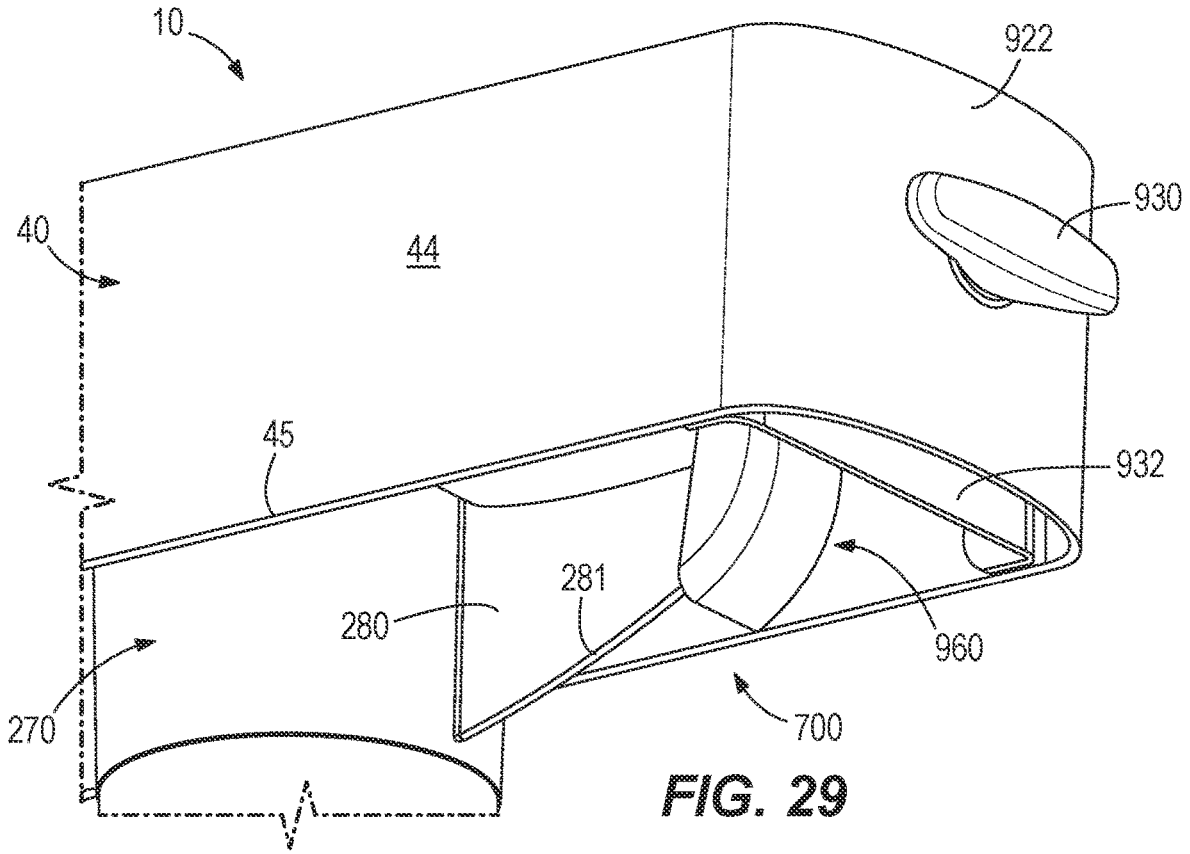
FIG. 29 is a front perspective view of another embodiment of a lock device according to the present disclosure.
Figure 30:
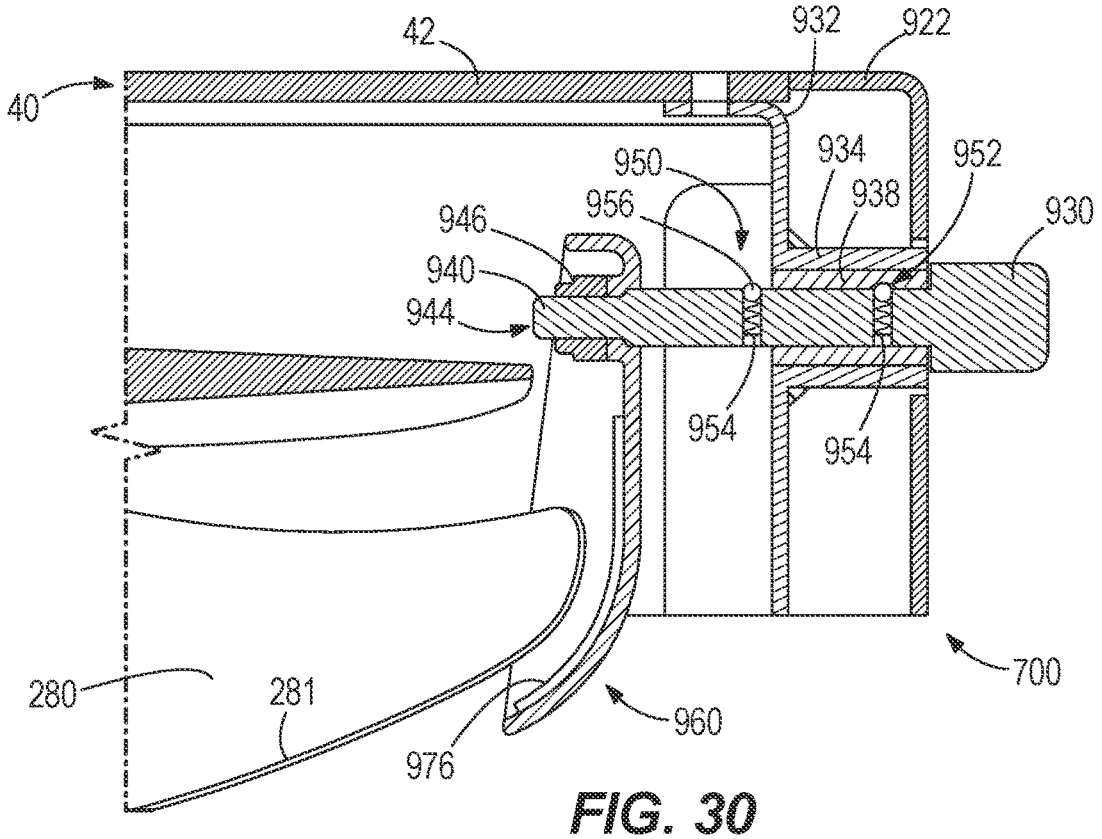
FIG. 30 is a sectional side view of the propulsion device of FIG. 29.

Another lock device 700 is shown in FIGS. 29 and 30, whereby instead of the entire front of the propulsion device 10 moving (sliding number 120), a handle 930 extends outwardly and is slidable for engaging and disengaging the lock device 700. The handle 930 is coupled to the plunger 940 such that pressing the handle 230 toward the base 940 moves the hook 960 into engagement with the fin 280 as discussed above, and withdrawing of the handle 930 causes disengagement with the lock device 700. Additionally, FIG. 30 shows the plunger 940 including a first detent 48 and a second detent 950 each having a spring 954 that biases a ball 956 in a manner known in the art. The balls 956 are configured to engage with an opening 952 defined within the bushing 938 inside the barrel 934 of the end plate 932. In this manner, pressing the handle 930 forwardly caused the second detent 952 to engage, retaining the hook 960 in the locked position, and similarly withdrawing the handle 930 until the ball 956 of the first detent 948 engages with the opening 952 retains the hook 960 in the disengaged position.

In certain examples, the lock device 700 further includes a sensor such as the positional sensor 300 from FIG. 6 discussed above (e.g., a switch or a Hall effect sensor) that detects when the rigid member is positioned such that the lock device is engaged and prevents the propulsor 270 from pivoting away from the stowed position. The control system 600 communicates with this sensor and may thus be configure to prevent actuation of the actuator 240 when the lock device 700 is engaged. This prevents damage to the actuator 240, lock device 700, propulsor 270, and/or other components if the operator forgets to disengage the lock device 700 before attempting to pivot the propulsor 270. Additional feedback may also be provided to the operator based on the detected state of the lock device 700, including an indication at the helm when the control system 600 is preventing operation of the actuator 240 based on the engagement of the lock device 700, and/or to show a current state of the lock device 700. In certain examples, a reminder to engage the lock device 700 may also be provided, so example when trailering another propulsor on the marine vessel 1.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A propulsion device for a marine vessel having a deck, the propulsion device comprising:

a base configured to be coupled to the marine vessel so as to be below the deck thereof;

a propulsor pivotally coupled to the base via a shaft and pivotable into and between a deployed position and a stowed position, wherein the propulsor is configured to propel the marine vessel in water when in the deployed position;

an actuator that pivots the propulsor between the stowed position and the deployed position; and a lock device having a rigid member and being coupled to the base, the lock device being selectively engageable such that the rigid member selectively supports at least one of the propulsor and the shaft to thereby prevent the propulsor from pivoting away from the stowed position.

2. The propulsion device according to claim 1, wherein the lock device includes a bracket coupled to the base and extending downwardly therefrom, wherein the bracket has first and second sides, the first side defining an opening therein, and wherein the rigid member is receivable through the opening defined in the first side to prevent the propulsor from pivoting away from the stowed position.

3. A propulsion device for a marine vessel, the propulsion device comprising:

a base configured to be coupled to the marine vessel;

a propulsor pivotally coupled to the base and pivotable into and between a deployed position and a stowed position, wherein the propulsor is configured to propel the marine vessel in water when in the deployed position; and a lock device selectively engageable to prevent the propulsor from pivoting away from the stowed position, the lock device comprising a bracket having a first side and a second side each having an opening therein, the lock device further comprising a pin configured to be axially inserted into the openings in the first side and in the second side of the bracket simultaneously to engage the lock device.

4. The propulsion device according to claim 3, wherein the openings in the first side and in the second side of the bracket are lower openings, the first side and the second side of the bracket each further having an upper opening therethrough that is positioned above the lower openings, respectively, and wherein the pin is positioned in the upper openings the propulsor is unrestricted by the pin in pivoting away from the stowed position.

5. A propulsion device for a marine vessel, the propulsion device comprising:

a base configured to be coupled to the marine vessel;

a propulsor pivotally coupled to the base and pivotable into and between a deployed position and a stowed position, wherein the propulsor is configured to propel the marine vessel in water when in the deployed position; and a lock device selectively engageable via press-fit to prevent the propulsor from pivoting away from the stowed position.

6. The propulsion device according to claim 5, wherein the propulsor is pivotally coupled to the base via a shaft, further comprising a resilient sleeve configured to be sandwiched between the shaft and the bracket for selectively engaging the lock device.

7. The propulsion device according to claim 1, wherein the lock device includes a bracket coupled to the base and extending downwardly therefrom, wherein the actuator is configured such that while the propulsor is in the stowed position the shaft exerts a force upwardly against the bracket.

8. The propulsion device according to claim 1, wherein the rigid member is pivotally coupled to the base.

9. The propulsion device according to claim 8, wherein the propulsor is pivotable about a horizontal axis, and wherein the rigid member pivots about a vertical axis that is perpendicular to the horizontal axis.

10. The propulsion device according to claim 8, wherein the propulsor is pivotally coupled to the base by a shaft, wherein the rigid member has upper and lower arms, and wherein when the lock device is engaged the shaft is positioned between the upper and lower arms.

11. The propulsion device according to claim 8, wherein the rigid member when engaged engages with the propulsor.

12. The propulsion device according to claim 11, wherein the propulsion device includes a skeg, and wherein the rigid member engages with the skeg.

13. The propulsion device according to claim 11, wherein the base comprises sides that extend downwardly from the marine vessel, wherein openings are defined through the sides of the base, wherein the locking device comprises a locking axle that is received through the openings in the sides of the base, and wherein the locking device is pivotable about the locking axle.

14. The propulsion device according to claim 1, further comprising an end cap translatable relative to the base into and between a first position and a second position, wherein the rigid member is coupled to the end cap to translate therewith such that the lock device is engaged only when the end cap is in the second position.

15. The propulsion device according to claim 1, wherein the base comprises sides that extended downwardly from the marine vessel and an end plate that extends downwardly between the sides, wherein an opening is defined through the end plate, wherein the lock member further comprises a locking plunger received through the opening in the end plate, and wherein the rigid member is coupled to the locking plunger and the lock device is engageable by translating the rigid member through the opening in the end plate towards the propulsion device.

16. The propulsion device according to claim 15, wherein the propulsion device includes a skeg, and wherein the rigid member supports the skeg when the lock device is engaged.

17. The propulsion device according to claim 1, further comprising a detent engageable in first and second positions that retain the locking device in fully engaged and fully disengaged positions, respectively.

18. A method for making a propulsion device for a marine vessel having a deck, the method comprising:

configuring a base to be coupleable to the marine vessel so as to be below the deck thereof;

pivotably coupling a propulsor to the base via a shaft, wherein the propulsor is pivotable into and between a deployed position and a stowed position wherein the propulsor is configured to propel the marine vessel in water when in the deployed position;

configurating an actuator so as to be operable to pivot the propulsor between the stowed position and the deployed position; and coupling a lock device to the base, the lock device having a rigid member and being selectively engageable such that the rigid member selectively supports at least one of the propulsor and the shaft to thereby prevent the propulsor from pivoting away from the stowed position.

19. The method according to claim 18, wherein the rigid member is pivotally coupled to the base such that pivoting the rigid member selectively engages the lock device.

20. A method for making a propulsion device for a marine vessel, the method comprising:

configuring a base to be coupleable to the marine vessel;

pivotably coupling a propulsor to the base, wherein the propulsor is pivotable into and between a deployed position and a stowed position wherein the propulsor is configured to propel the marine vessel in water when in the deployed position; and coupling a lock device to the base, the lock device having a rigid member and being selectively engageable to prevent the propulsor from pivoting away from the stowed position;

wherein the lock device includes a bracket coupled to the base and extending downwardly therefrom, wherein the bracket has a first side and a second side each defining openings therethrough, and wherein the rigid member is a pin axially insertable through the openings to prevent the propulsor from pivoting away from the stowed position.

* * * * *